US008586845B2

(12) United States Patent
Rovner

(10) Patent No.: US 8,586,845 B2
(45) Date of Patent: Nov. 19, 2013

(54) REED WARP MOUTHPIECE SYSTEM

(76) Inventor: Philip Lee Rovner, Timonium, MD (US)

( * ) Notice: Subject to any disclaimer, the term of this patent is extended or adjusted under 35 U.S.C. 154(b) by 0 days.

(21) Appl. No.: 13/537,849

(22) Filed: Jun. 29, 2012

(65) Prior Publication Data

US 2012/0266736 A1 Oct. 25, 2012

Related U.S. Application Data

(63) Continuation-in-part of application No. 13/051,192, filed on Mar. 18, 2011, now Pat. No. 8,283,541, which is a continuation-in-part of application No. 12/613,097, filed on Nov. 5, 2009, now Pat. No. 7,982,112, which is a continuation-in-part of application No. 12/333,174, filed on Dec. 11, 2008, now Pat. No. 7,939,738, which is a continuation-in-part of application No. 12/040,969, filed on Mar. 3, 2008, now Pat. No. 7,863,509.

(51) Int. Cl.
*G10D 9/02* (2006.01)

(52) U.S. Cl.
USPC ..... 84/383 R

(58) Field of Classification Search
USPC ..... 84/380 R, 383 R, 383 A, 380 A, 387 A
See application file for complete search history.

(56) References Cited

U.S. PATENT DOCUMENTS

| | | | |
|---|---|---|---|
| 1,667,836 | A | 5/1928 | Brockman, Jr. |
| 1,771,157 | A | 7/1930 | Paul |
| 2,095,605 | A | 10/1937 | Georges |
| 2,287,529 | A | 6/1942 | Mario |
| 2,296,737 | A | 9/1942 | Peterson |
| 2,368,556 | A | 1/1945 | Mario |
| 2,411,692 | A | 11/1946 | Murano |
| 2,499,855 | A | 3/1950 | Gamble |
| 2,517,077 | A | 8/1950 | Berry |
| 2,525,523 | A | 10/1950 | Harry |
| 3,150,554 | A | 9/1964 | Marcel |
| 3,433,113 | A | 3/1969 | Portnoy |
| 3,521,517 | A | 7/1970 | Sato |
| 3,759,132 | A | 9/1973 | Backus |
| 3,905,268 | A | 9/1975 | Gamble |
| 4,056,997 | A | 11/1977 | Rovner |

(Continued)

OTHER PUBLICATIONS

Passband, http://www.absoluteastronomy.com/topics/Passband viewed Mar. 17, 2011.

*Primary Examiner* — Kimberly Lockett
(74) *Attorney, Agent, or Firm* — August Law LLC; George Willinghan

(57) ABSTRACT

A reed warp mouthpiece system includes a mouthpiece with a bottom side having a concave cavity, a table portion and a rectangular window exposing a tone chamber and extending from the table portion. A reed is disposed on the bottom side of the mouthpiece spanning the cavity and includes a heel portion extending over the table portion and a tapered portion extending from the heel portion and covering the rectangular window. A plurality of parallel slits is provided in the reed. A ligature surrounds the mouthpiece and reed to secure the reed to the mouthpiece. This ligature includes a flexible strap having opposing ends defining a flexible strap length and opposing edges running between the opposing ends and defining a width. The length passes around the mouthpiece and the reed and the width is equal to the heel portion length so that the flexible strap completely covers the heel portion.

20 Claims, 21 Drawing Sheets

(56) References Cited

U.S. PATENT DOCUMENTS

| | | | | |
|---|---|---|---|---|
| 4,210,055 | A | 7/1980 | Platamone | |
| 4,308,781 | A | 1/1982 | Mcguerty | |
| 4,337,683 | A | 7/1982 | Backus | |
| 4,428,271 | A | 1/1984 | Winslow et al. | |
| 4,449,439 | A | 5/1984 | Wells | |
| 4,517,875 | A | 5/1985 | Dossekker | |
| 4,669,352 | A | 6/1987 | Bichon | |
| 4,708,182 | A | 11/1987 | Laker | |
| 4,745,838 | A | 5/1988 | Johnson | |
| 4,941,385 | A | 7/1990 | Johnson | |
| 5,018,425 | A | 5/1991 | Rovner | |
| 5,105,701 | A | 4/1992 | Hall et al. | |
| 5,192,821 | A | 3/1993 | Goldstein et al. | |
| 5,289,752 | A | 3/1994 | Barbaglia | |
| 5,293,805 | A | 3/1994 | Guardala et al. | |
| 5,303,628 | A | 4/1994 | Salazar | |
| 5,357,837 | A | 10/1994 | Disera | |
| 5,398,582 | A | 3/1995 | Smith | |
| 5,419,229 | A | 5/1995 | Van Doren | |
| 5,456,152 | A | 10/1995 | Cusack et al. | |
| 5,623,111 | A | 4/1997 | Doren et al. | |
| 5,728,957 | A | 3/1998 | Valtchev | |
| D404,755 | S | 1/1999 | Garbuzov | |
| 5,973,245 | A | 10/1999 | Van Doren | |
| 5,998,715 | A | 12/1999 | Rovner | |
| 6,020,545 | A | 2/2000 | Consoli | |
| 6,118,060 | A | 9/2000 | Van Doren | |
| 6,130,376 | A | 10/2000 | Chang | |
| 6,150,593 | A | 11/2000 | Holden | |
| 6,501,010 | B2 | 12/2002 | Sullivan | |
| 6,673,992 | B1 | 1/2004 | Runyon | |
| 7,169,993 | B2 | 1/2007 | Fliegel et al. | |
| 7,326,840 | B2 | 2/2008 | Wanne | |
| 7,465,864 | B2 | 12/2008 | Heintz | |
| 7,470,844 | B2 | 12/2008 | Espina | |
| 7,626,105 | B2 | 12/2009 | Rovner | |
| 7,635,287 | B2 | 12/2009 | May | |
| 7,638,700 | B1 * | 12/2009 | Heintz | 84/398 |
| 7,667,118 | B1 | 2/2010 | Behn | |
| 7,863,509 | B2 | 1/2011 | Rovner | |
| 7,939,738 | B2 | 5/2011 | Rovner | |
| 7,982,112 | B2 | 7/2011 | Rovner | |
| 2004/0011183 | A1 | 1/2004 | Fliegel et al. | |
| 2005/0061136 | A1 | 3/2005 | Rovner | |
| 2005/0061137 | A1 | 3/2005 | Rovner | |
| 2005/0072623 | A1 | 4/2005 | Rovner | |
| 2005/0087057 | A1 | 4/2005 | Taillard | |
| 2006/0272473 | A1 | 12/2006 | Kuo | |
| 2008/0022839 | A1 | 1/2008 | Sullivan | |
| 2009/0217798 | A1 | 9/2009 | Rovner | |
| 2009/0217800 | A1 | 9/2009 | Rovner | |
| 2010/0043621 | A1 | 2/2010 | Rovner | |
| 2011/0162508 | A1 | 7/2011 | Rovner | |

* cited by examiner

REED WARP MOUTHPIECE SYSTEM

CROSS-REFERENCE TO RELATED APPLICATIONS

The present application is a continuation-in-part of co-pending U.S. application Ser. No. 13/051,192, filed Mar. 18, 2011, which is a continuation-in-part of co-pending U.S. application Ser. No. 12/613,097, filed Nov. 5, 2009, which is a continuation-in-part of co-pending U.S. application Ser. No. 12/333,174, filed Dec. 11, 2008, which is a continuation-in-part of U.S. application Ser. No. 12/040,969 filed Mar. 3, 2008, which issued as U.S. Pat. No. 7,863,509. The entire disclosures of all of these applications are incorporated herein by reference.

FIELD OF THE INVENTION

The present invention relates to woodwind instruments and in particular to mouthpieces for woodwind instruments.

BACKGROUND OF THE INVENTION

Woodwind musical instruments, e.g., saxophones and clarinets, and other devices such as bird calls utilize the vibration of a reed in response to a flow of air to generate a tone. These reeds include natural cane reeds and synthetic reeds. Tone generation in general depends on proper reed vibration. The reed is typically placed in contact with a mouthpiece to cover an opening or window. The reed is held in place by an adjustable clamp or ligature that surrounds the mouthpiece and the reed. Variations in the mouthpiece and ligature affect the vibration of the reed and, therefore, the performance or tone of the device or instrument. Various ligatures have been proposed largely to improve the overall performance of the instrument.

In any device that is part of a vibrating system, differences in materials and construction yield different vibrational patterns and tonal spectrums. In a typical prior art ligature, the configuration was premised largely on the objective of permitting the reed to vibrate with greater freedom and less constriction. In U.S. Pat. No. 5,998,715, the tone is altered in accordance with user preference by alternating the weight of the cradle that interfaced the reed. This arrangement demonstrated that variations in the mass of the ligature construction influence the performance of the ligature. However, the arrangement was complex in that the fastening elements at the end of the body were not utilized effectively in mass-loading the ligature in the region of the reed.

On single-reed woodwind instruments, the player typically adjusts the tension of the ligature, when tightened around and over the mouthpiece and reed, so as to affix the reed in place securely, and yet not so tightly as to inhibit free vibration of the reed. In many cases, because of the way the player positions the mouthpiece in his/her mouth, or because of the individual's mouth structure, the reed often tends to shift sidewise during playing, degrading performance and requiring constant repositioning by the player. In order to minimize reed shift many players will tighten the ligature as tight as possible, thereby causing not only a reduction in the playing freedom and tone, but causing the heel of the reed heel to compress and distort, which results in the lifting of the tapered end of the reed away from the rails of the mouthpiece; which induces air leakage between the reed and the mouthpiece and a resultant deterioration in playing performance. Typically, the heel of reeds used on single-reed instruments has a length such that ligatures of prior art only grasp approximately ⅔ of the full length of the heel of the reed. In some cases, some ligatures are so narrow that they contact but a fraction of reed heel.

SUMMARY OF THE INVENTION

The present invention is directed to ligatures and mouthpiece systems utilizing these ligatures that provide for increased performance in a woodwind instruments through the reduction of interfering vibrational frequencies from the ligature. A ligature is provided that includes a strap or body made of any suitable material, for example sheet metal, a rubberized fabric sheet or sheet plastic. The unitary strap encircles the mouthpiece and reed, and the ends of the strap terminate in relatively large masses that are in the form of cylindrical rods. An overlap or reverse bend is configured adjacent to each rod, and the ends of the ligature are affixed to the rods by suitable means. Preferably, the overlapped ends of the strap are crimped into slots in the rods. For metallic straps, a small cushion made of a resilient material, such as rubber, is located within the slots between the layers of overlapped strap. When the strap is fabric, a resilient metal shim is located between the overlapping layers in the slot.

A plurality of parallel slots or slits are incorporated into the strap adjacent the ends in of the reverse bend. A fastening or closure mechanism is provided that passes through holes in each rod to permit affixing the ligature to the reed and mouthpiece.

When the ligature is assembled to the mouthpiece and reed, the inner surface of the ligature body presses on the reed in a highly compliant manner as a result of the tightening pressure exerted upon the cushion and the ligature body by the rods. The relatively heavy rods in conjunction with the compliance features lower the frequency band of the internal resonances of the ligature, improving the tonal quality, playing freedom, intonation, and response of the instrument.

In accordance with one embodiment, the present invention is directed to a ligature for a mouthpiece. The ligature includes a loop made from a thin resilient flexible strap having two ends. The loop is sized to encircle a mouthpiece. A mass is attached to the strap and has a sufficient weight to lower passband frequencies of internal resonances of the ligature sufficiently below passband frequencies of a vibrating reed secured to the mouthpiece by the ligature. In one embodiment, the mass is disposed on at least one of the two ends of the strap. Alternatively, the mass is two substantially equal masses, and each one of the two masses is attached to one of the two ends of the strap. Suitable shapes for the masses include cylindrical rods.

In one embodiment, the strap further has two parallel sides running between the two ends, and each cylindrical rod is aligned along each end to intersect each one of the two parallel sides at an angle other than 90° to create a frusto-conical shaped loop that accommodates a tapered mouthpiece. In one embodiment, each mass further includes a slot, and the corresponding end of the strap attached to each mass is disposed and securely anchored in the slot. In one embodiment, the strap is made from a rubberized fabric, and each end of the strap includes an overlapping fold forming two layers of the strap. Both of the layers are disposed within the slot. A metal shim can be provided between the two layers of the strap at each end of the strap. In another embodiment, the strap is a metal strap, and each end of the strap includes an overlapping fold forming two layers of the strap. Both layers disposed within the slot. A strip of rubberized fabric can be provided between the two layers of the strap at each end of the strap.

In one embodiment, each mass is a cylindrical rod, and each slot extends along an entire length of the cylindrical rod and partially into the cylindrical rod along a non-diametric secant line. The ends of the strap are disposed over the reed when the ligature is attached to the mouthpiece, and the non-diametric secant line intersects a plane tangent to the outer surface of the reed at a point between the two ends of the ligature at an angle of from about 40° to about 45°.

The present invention is also directed to a woodwind mouthpiece system that includes a mouthpiece, a reed in contact with the mouthpiece and a ligature surrounding the mouthpiece and the reed to secure the reed to the mouthpiece. The ligature includes a loop of a thin resilient flexible strap having two ends. The loop encircles the mouthpiece, and the ends of the strap are disposed over the reed. The mouthpiece system also includes two substantially equal masses. Each mass is attached to one of the ends of the strap and is spaced from the reed. The two masses in combination provide enough weight to lower passband frequencies of internal resonances of the ligature sufficiently below passband frequencies of the reed when vibrating.

In one embodiment, each mass further includes a slot running along its length. The corresponding end of the strap attached to each mass is disposed and securely anchored in the slot. In one embodiment, the strap is a rubberized fabric, and each end of the strap includes an overlapping fold forming two layers of the strap. Both layers are disposed within the slot, and a metal shim can be provided between the two layers of the strap at each end of the strap. In one embodiment, the strap is metal, and each end of the strap includes an overlapping fold forming two layers of the strap. Both layers are disposed within the slot, and a strip of rubberized fabric is disposed between the two layers of the strap at each end of the strap. In one embodiment, each mass is a cylindrical rod, and each slot extends along an entire length of the cylindrical rod and partially into the cylindrical rod along a non-diametric secant line. The ends of the strap are disposed over the reed when the ligature is attached to the mouthpiece, and the non-diametric secant line intersects a plane tangent to the outer surface of the reed at a point between the two ends of the ligature at an angle of from about 40° to about 45°.

In accordance with one exemplary embodiment, the present invention is directed to a ligature for a mouthpiece that includes a loop sized to encircle a mouthpiece. The loop is constructed of a single layer of resilient flexible strap having two opposing ends and two opposing parallel sides. In one embodiment, the flexible strap is constructed of rubberized fabric. The two opposing parallel sides include a first side having a first length and a second side having a second length. The second length is greater than the first length. In addition, the loop includes a plurality of slits extending partially across the flexible strap from either end of the flexible strap parallel to the sides of the flexible strap. In one embodiment, each one of the plurality of slits is spaced from a respective end of the flexible strap and extends across the flexible strap a distance of from about ¾ of an inch to about 1 inch.

The ligature also includes a pair of rigid bars. Each bar is attached to one of the opposing ends of the flexible strap and extends between the opposing parallel sides. In one embodiment, each rigid bar is a cylindrical rod having a diameter of about ¼ of an inch, and the flexible strap has a thickness of about 1/32 of an inch. In one embodiment, each rigid bar is a cylindrical rod, and each cylindrical rod has a slot extending partially into the cylindrical rod and running along a length of the cylindrical rod. A corresponding end of the single layer flexible strap is disposed and anchored in the slot. Each cylindrical rod further also includes a hole passing completely through the cylindrical rod. Each slot extends diametrically into the cylindrical rod along a first diameter, and each hole passes diametrically through the cylindrical rod along a second diameter. In one embodiment, the first diameter is perpendicular to the second diameter. Alternatively, the first diameter intersects the second diameter at an angle that deviates from perpendicular by up to about 7 degrees.

In one embodiment, each cylindrical rod is aligned along each end to intersect each one of the two opposing parallel sides at an angle other than 90° to create a frusto-conical shaped loop that accommodates for a tapered mouthpiece. In one embodiment, each cylindrical rod further includes a flat region running the length of the cylindrical rod and extending from one side of the slot partially around the circumference of the cylindrical rod. The flat regions are disposed in the interior of the loop. In one embodiment, the flexible strap includes a first side having a rough texture and a second side having a smooth texture. The first side forms an inner surface of the loop, and the second side forms an outer surface of the loop.

The present invention is also directed to a ligature for a mouthpiece that includes a loop sized to encircle a mouthpiece and constructed from a resilient flexible strap, e.g., a rubberized fabric strap, having two opposing ends and two opposing parallel sides. The ligature also includes a u-shaped cradle constructed from a flexible, resilient material, e.g., spring steel. The cradle is attached to the flexible strap between the two opposing ends and is disposed within an interior of the loop. The ligature also includes a pair of rigid bars. Each bar is attached to one of the opposing ends of the flexible strap and extends between the opposing parallel sides.

In one embodiment, the cradle includes a central portion in contact with the flexible strap and a pair of wings extending from the central portion to form the u-shape. The wings extend from the central portion so as to form an angle of from about 30 degrees to about 50 degrees with the flexible strap, when the flexible strap is positioned flat in a single plane. In one embodiment, each wing includes a plurality of parallel slits. The parallel slits arranged parallel to the opposing sides of the flexible strap. In one embodiment, the parallel slits are spaced apart by a variable distance that increases when moving along each wing from a first parallel side to a second parallel side. This variable distance increases from about 1/10 of an inch to about 2/10 of an inch. Preferably, the parallel slits do not extend into the central portion or into edges of the wings, and each slit has a length of about ⅜ of an inch. In one embodiment, the flexible strap has a first side having a rough texture and a second side having a smooth texture. The first side forms an inner surface of the loop, and the second side forms an outer surface of the loop. The cradle is attached to the first side. In one embodiment, the cradle is rectangular and has a size of about 1 inch by about 1 inch.

The present invention is also directed to a woodwind mouthpiece system that includes a mouthpiece, a reed in contact with the mouthpiece and a ligature surrounding the mouthpiece and the reed to secure the reed to the mouthpiece. Suitable ligatures include any of the ligatures in accordance with the present invention.

In accordance with one exemplary embodiment, the present invention is directed to a ligature for a mouthpiece having a loop sized to encircle a mouthpiece. This loop includes a single layer of resilient flexible strap having two opposing ends and two opposing parallel sides. The two opposing parallel sides include a first side having a first length and a second side having a second length, the second length greater than the first length. The loop also includes a plurality of slits extending partially across the flexible strap from either end of the flexible strap parallel to the sides of the flexible strap. The parallel slits do not extend completely across the flexible strap, and a space exists between the parallel slits extending from opposite ends of the flexible strap. This space is about 6% to about 7% of the entire length either the first length or the second length. In one embodiment, the space has a length of about ¼ of an inch. In one embodiment, each one of the plurality of slits is spaced from a respective end of the flexible strap and extends across the flexible strap a distance of from about ¾ of an inch to about 1 inch.

In one embodiment, for example where the flexible strap is a metal strap, the slits are slots, and the flexible strap includes a plurality of slots extending partially across the flexible strap from either end of the flexible strap parallel to the sides of the flexible strap. The space between parallel slots extending from opposite ends of the flexible strap is about 16% to about 17.5% of the entire length of either the first length or the second length. In one embodiment, the space has a length of ½ inches or 9/16 inches.

The ligature also includes a pair of rigid bars. Each bar is attached to one of the opposing ends of the flexible strap and extends between the opposing parallel sides. In one embodiment, each rigid bar is a cylindrical rod having a diameter of about ¼ of an inch, and the flexible strap has a thickness of about 1/32 of an inch. In one embodiment, each rigid bar is a cylindrical rod, and each cylindrical rod has a slot extending partially into the cylindrical rod and running along a length of the cylindrical rod. A corresponding end of the single layer flexible strap is disposed and anchored in the slot. In on embodiment, each cylindrical rod includes a hole passing completely through the cylindrical rod.

Each slot extends diametrically into the cylindrical rod along a first diameter, and each hole passes diametrically through the cylindrical rod along a second diameter. The first diameter is perpendicular to the second diameter. In one embodiment, each slot extends diametrically into the cylindrical rod along a first diameter, and each hole passes diametrically through the cylindrical rod along a second diameter. The first diameter intersects the second diameter at an angle that deviates from perpendicular by up to about 7 degrees.

In one embodiment, each cylindrical rod is aligned along each end to intersect each one of the two opposing parallel sides at an angle other than 90° to create a frusto-conical shaped loop that accommodates for a tapered mouthpiece.

In one embodiment, the flexible strap is a rubberized fabric. The flexible strap includes a first side having a rough texture and a second side having a smooth texture. The first side makes up an inner surface of the loop, and the second side makes up an outer surface of the loop. In one embodiment, each cylindrical rod also includes a flat region running the length of the cylindrical rod and extending from one side of the slot partially around the circumference of the cylindrical rod. The flat regions are disposed in the interior of the loop.

The present invention is also directed to a ligature for a mouthpiece. This ligature includes a loop of a thin resilient flexible strap having two ends. The loop is sized to encircle a mouthpiece. A pair of rigid bars is provided such that each bar attached to one of the ends of the flexible strap. A pair of removable masses is attached to the removable strap. Each removable mass is in contact with one of the rigid bars, and the pair of removable masses in combination adds sufficient weight to the ligature to lower passband frequencies of internal resonances of the ligature sufficiently below passband frequencies of a vibrating reed secured to the mouthpiece by the ligature.

In one embodiment, the pair of removable masses is identical masses. Each removable mass has a cavity having a shape that accommodates one of the rigid bars. The rigid bar is disposed in the cavity when the removable mass is attached to the flexible strap. When each rigid bar is a cylindrical rod with rounded ends, the cavity in each removable mass has a curved pocket with curved ends. Each rigid bar and each removable mass includes a single through hole. All of the through holes of the rigid bars and removable masses are aligned when the removable masses are attached to the flexible strap. A threaded rod passes completely through all of the through holes, and a thumbscrew is attached to a distal end of the threaded rod. The threaded rod and thumbscrew secure the removable masses to the flexible strap.

In accordance with one exemplary embodiment, the present invention is directed to a ligature for a mouthpiece having a loop sized to encircle a mouthpiece. The loop is constructed from a flexible strap having two opposing ends and two opposing parallel sides. A pair of rigid bars is provided, and each bar is in contact with the flexible strap and extends between the opposing parallel sides of the flexible strap. In one embodiment, the flexible strap is formed as two overlapping layers to define two separate pockets such that the ends of the flexible strap are disposed in the interior of the loop. Each rigid bar is disposed in one of the pockets. Stitching is provided through the overlapping layers. In one embodiment, the flexible strap is formed as two overlapping layers that define interior and exterior flexible strap layers of the loop. The ends of the flexible strap are disposed in the interior flexible strap layer in the interior of the loop, and each end extends at least partially over the cradle that is attached to the flexible strap and located in the interior of the loop.

In one embodiment, a cradle is attached to an interior surface of the exterior layer of the flexible strap, and each end is positioned between the cradle and the interior surface of the exterior layer of the flexible strap. In another embodiment, the cradle is attached to an interior surface of the exterior layer of the flexible strap, and the cradle is positioned between each end and the interior surface of the exterior layer of the flexible strap. In one embodiment, the flexible strap includes a first side having a rough texture and a second side having a smooth texture. The first side forms the exterior surface of the loop, and the second side forms at least a portion of the interior surface of the loop. The cradle is attached to the second side.

In one embodiment, the cradle is attached to the flexible strap and disposed within an interior of the loop. The cradle includes a plurality of separate and identical cradle members arranged in a stack. In one embodiment, the cradle has four cradle members. Each cradle member is constructed from brass, black oxide brass, copper or stainless steel and has a thickness of about 1/32 of an inch. Each cradle member has a central portion and a pair of wings extending from the central portion to form a u-shape. In one embodiment, each central portion is in contact with at least one fastener securing the cradle to the flexible strap. The wings extend from the central portion so as to form an angle of from about 10 degrees to about 20 degrees with the flexible strap when the flexible strap is positioned flat in a single plane. In one embodiment, each wing of each cradle member is shaped to contact a reed attached to a mouthpiece by the ligature along up to about 15% of a surface area of the reed that overlaps the cradle. In one embodiment, each cradle member is generally rectangular and has a size of about 1 and 3/16 of an inch by about 11/16 of an inch. Preferably, the cradle has a weight sufficient to lower passband frequencies of internal resonances of the ligature sufficiently below passband frequencies of a vibrating reed secured to a mouthpiece by the ligature. In one embodiment, only one of the central portions is in contact with the flexible strap.

The present invention is also directed to a woodwind mouthpiece system that includes a mouthpiece, a reed in contact with the mouthpiece and a ligature surrounding the mouthpiece and the reed to secure the reed to the mouthpiece. The ligature includes a loop sized to encircle a mouthpiece. The ligature is constructed from a flexible strap having two opposing ends and two opposing parallel sides. A cradle is attached to the flexible strap and disposed within an interior of the loop. This cradle is constructed from a plurality of separate and identical cradle members arranged in a stack. A pair of rigid bars is provided such that each bar is in contact with the flexible strap and extends between the opposing parallel sides.

In one embodiment, each cradle member includes a central portion and a pair of wings extending from the central portion to form a u-shape. Each central portion is in contact with at least one fastener securing the cradle to the flexible strap, and only one of the central portions is in contact with the flexible strap. In one embodiment, the flexible strap is formed as two overlapping layers defining interior and exterior flexible strap layers of the loop. The ends of the flexible strap are disposed in the interior flexible strap layer in the interior of the loop, and each end extends at least partially over the cradle.

In accordance with one exemplary embodiment, the present invention is directed to a reed warp mouthpiece system containing a mouthpiece, a reed and a ligature. The mouthpiece has a bottom side containing a table portion and a rectangular window exposing a tone chamber and extending from the table portion. In one embodiment, the bottom side of the mouthpiece further includes a concave portion extending into the mouthpiece. This concave portion defines a gap between the reed and the mouthpiece. In one embodiment, the concave portion is disposed in the table portion of the bottom side. In another embodiment, the bottom portion includes a pair of side rails extending from the table portion along either side of the rectangular window, and the concave portion extends partially along each side rail.

The reed is disposed on the bottom side of the mouthpiece and includes a heel portion having a heel portion length and extending over the table portion and a tapered portion extending from the heel portion and covering the rectangular window. In one embodiment, the heel portion of the reed includes a rounded top surface and a bottom surface opposite the rounded top surface, facing the bottom side of the mouthpiece and extending along a reed length from the heel portion to the tapered portion. A plurality of parallel slits run along the heel length in the heel portion and pass from the rounded top surface partially toward the bottom surface. In one embodiment, the plurality of slits extends partially through the tapered portion. In one embodiment, each slit has a width of less than about 0.25 mm and a depth less than or equal to about 0.0625 inches.

The ligature surrounds the mouthpiece and reed to secure the reed to the mouthpiece. The ligature includes a flexible strap having opposing ends defining a flexible strap length. Opposing edges run between the opposing ends and define a width. The length passes around the mouthpiece and the reed, and the width is equal to the heel portion length. The flexible strap is arranged to completely cover the heel portion. In one embodiment, the width of the flexible strap is about 1.375 inches. The ligature also includes a pair of cylindrical masses. Each cylindrical mass is attached to one of the opposing ends of the flexible strap and has a circular cross section and a cylindrical mass length equal to the width of the flexible strap. In one embodiment, the circular cross section of each cylindrical mass has a diameter of about 0.28 inches.

DETAILED DESCRIPTION

Figure 1:
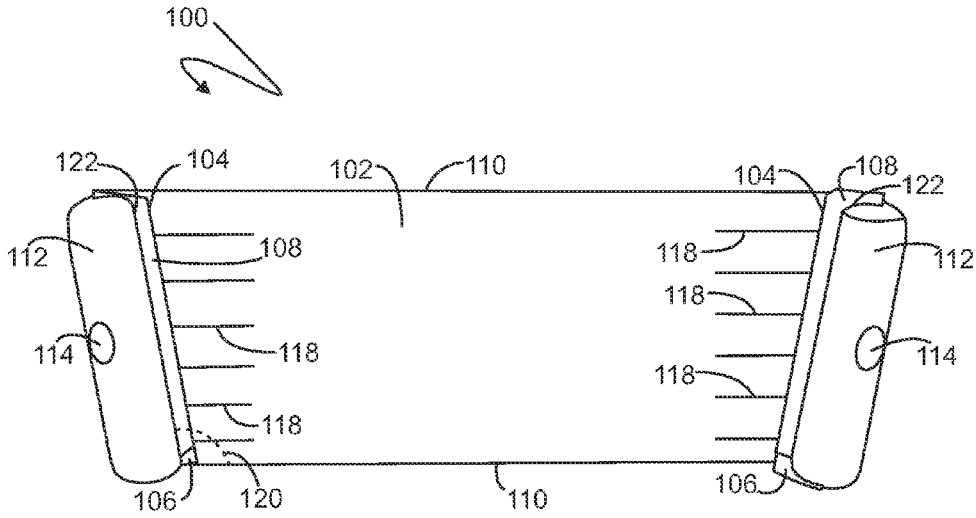
FIG. 1 is a plan view of a first side of an embodiment of a ligature in accordance with the present invention.
Figure 2:
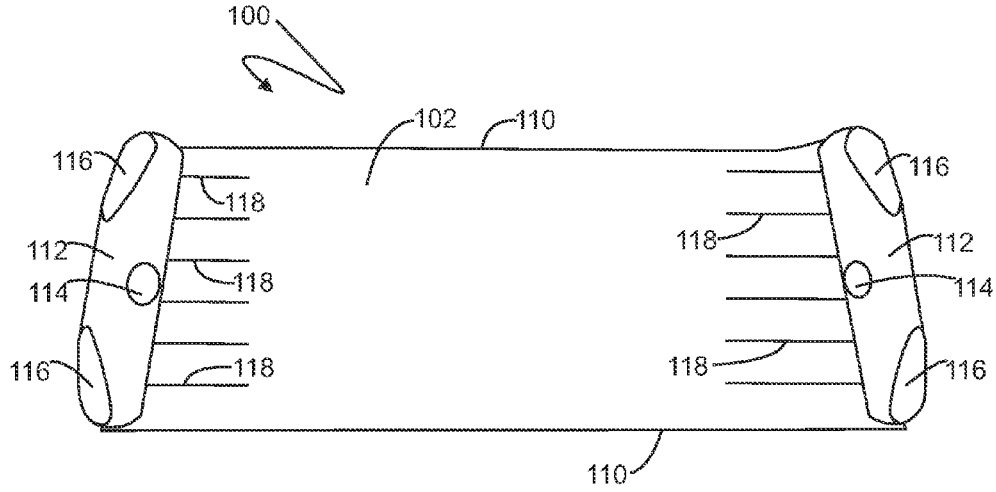
FIG. 2 is a plan view of a second side of the ligature of FIG. 1.

Referring initially to FIGS. 1 and 2, an exemplary embodiment of a ligature 100 in accordance with the present invention is illustrated. This ligature, and all embodiments of ligatures disclosed herein, is used to secure reeds to a mouthpiece for use with a woodwind instrument, e.g., a single reed woodwind instrument such as a clarinet or saxophone, or any other type of device where a vibrating reed is secured to a mouthpiece. The ligature includes a thin resilient flexible strap 102 having two opposite ends 104. As illustrated, the thin flexible strap is generally rectangular in shape; however, the strap can be other shapes including square, circular or trapezoidal. The strap is sized in accordance with the size of the mouthpiece to which the ligature is applied. In one embodiment, the flexible strap is about 1" to about 1.25" wide and about 3.0" or 3.5" to about 4" long. In one embodiment, the flexible strap has a thickness of about 0.035".

Preferably, the width of the ligature strap is selected to span as much of the length of the reed as practical to decrease the unit pressure exerted by the strap in contact with the reed. A decrease in unit contact pressure on the reed allows the reed to vibrate more freely . . . . In one embodiment, the width of the ligature spans an entire length of the heel portion of the reed that is attached to the mouthpiece using the ligature. In one embodiment, this width is about 1.375 inches (35 mm). Alternatively, the width is equal to a length of the plurality of slits cut into and along the grain of the reed. These slits can extend the length of the heel portion of the reed and can also extend into a tapered portion of the reed. These ligature dimensions including the widths can be applied to any arrangement of ligature disclosed herein. Widening the ligature body, i.e., the width, to cover the full length of the reed heel better secures the reed against shifting, with less clamping pressure per unit area of the reed heel. Not only does this reduce reed shift and the compression of the reed heel and attendant reed warp, it synergistically improves the general playing performance as well. The reduction in unit area pressure on the reed heel improves performance by reducing the reflection of vibratory energy from the tip of the reed, such that more of the energy passes into the reed heel, where it is dissipated. This helps to subdue unwanted reed resonances and allows air column resonances to dominate. In one embodiment, the ligature is constructed in a manner that enables the ligature to clamp the reed along edges of the reed, in a cushioned manner so as to minimize reed distortion, and also to clamp the reed in a manner that has been found to elicit the best reed performance.

Suitable materials for the flexible strap include, but are not limited to polymers, elastomers, metals and combinations thereof. As illustrated in FIGS. 1 and 2, the flexible strap is a rubberized fabric sheet. The flexible strap can be formed into a loop by bringing the two ends together. The loop is sized to encircle a mouthpiece. In one embodiment, at either end of the flexible strap is a plurality of generally parallel slits 118. Each slit runs from one of the ends a given distance into the strap in a direction that is generally parallel to the two parallel sides 110 of the flexible strap. As illustrated, each end contains six slits. The slits contribute additional compliance or form-fitting flexibility to the strap to enhance the function of the ligature. The number of slits provided on each end can be varied depending on the amount of compliance desired or required.

In one embodiment, the ligature includes at least one mass 112 attached along the strap. Alternatively, a plurality of masses is attached along the flexible strap. Preferably, the ligature includes two masses. In one embodiment, the masses are substantially equal. The mass or combination of masses, in combination with the high compliance construction of the ligature strap, provides sufficient weight to the ligature to lower the passband frequencies of internal resonances of the ligature sufficiently below passband frequencies of the vibrating reed that is secured to the mouthpiece by the ligature. In general, the weight of the mass is significantly more than the weight of the flexible strap. In one embodiment, the ligature contains one mass attached to at least one of the ends of the flexible strap. In another embodiment, the ligature includes two masses, each attached to one of the ends, i.e., opposite ends, of the flexible strap.

Suitable materials for the mass include any material that can produce an adequate amount of weight to achieve the desired passband frequency reduction within the space constraints of a mouthpiece. Preferably, the mass is metal. Suitable metals include, but are not limited to, copper, brass and stainless steel. In one embodiment, each mass is constructed from cylindrical bar stock having a diameter of from about 0.25" to about 0.5" and preferably about 0.375". In one embodiment, the diameter of the bar stock is about 0.28 inches (7 mm). The length of each cylindrical mass is from about 1" to about 1.5" and preferably about 1.25". In one embodiment, each cylindrical mass has a length equal to the width of the flexible strap. In one embodiment, this length is about 1.375 inches (935 mm). Therefore, if the width of the flexible strap spans an entire length of the heel portion of the reed, each mass also extends along the reed heel. The rigid rods are lengthened to the full width of the ligature body and are made larger in diameter so as to increase their mass so as to lower resonant frequencies of the ligature below the passband operating frequency.

The mass can also be a rectangular or square rod or any other elongated shape. In one embodiment, each mass includes at least one diametric hole 114 disposed along the length of the cylindrical mass. When one diametric hole is included in each mass, the hole is located generally at the midpoint along the length of the cylindrical mass. In one embodiment, each hole has a diameter of about 0.15". In one embodiment, both ends of each mass include tapers 116, cutouts, bevels or chamfers. These two tapers can be used to adjust, i.e., remove, mass. In addition, the tapers provide clearance for the chin of a user when the ligature is attached a mouthpiece. In one embodiment, all of the masses are identical in size, weight and configuration. Since a mass may have to be rotated 180° depending on the end of the flexible strap to which it is attached, having identical tapers on either end of each mass facilitates placement of any given mass on either end of a flexible strap.

Each mass can be fixedly or removable secured to a given end of the flexible strap. Having masses removably attached facilitates exchanging or replacing masses. Preferably, each mass is fixedly secured to a given end of the flexible strap. Suitable attachment mechanisms include, but are not limited to, fasteners such as rivets and adhesives. In one embodiment, a slot 122, having for example a "U" shaped or rectangular cross section, is provided along the length of each mass. Each slot can extend either partially or entirely along the length of each mass and extends into the mass, for example either diametrically or non-diametrically. In one embodiment, each slot has a depth that extends partially into the cylindrical rod along a non-diametric secant line.

The ends of the flexible strap are inserted into the slot, and the mass is crimped closed on the strap, securely anchoring the strap into the mass. In this embodiment, the material of the strap provides the desired cushioning and vibrational isolation or dampening between each mass and the mouthpiece to which the ligature is attached. In one embodiment, an overlap 108 is provided at each end to form two layers of the flexible strap that are inserted into the slot. Overlapping increases the level of cushioning as well as the stability of the bond between the mass and the strap. In addition, a rigid insert 106 is provided between the overlapping layers at the ends of the flexible strap. The rigid insert also improves the stability of the attachment between the flexible strap and the mass. Suitable materials for the rigid insert include rigid plastics and metals including brass and stainless steel. In one embodiment, the rigid insert is a metal shim having a thickness of less than about 0.0625" and preferably about 0.01". Although each mass can be attached to the flexible strap so that the mass intersects the sides 110 of the flexible strap at an angle 120 of about 90°, preferably the mass, i.e., the long axis of the cylindrical rod from which the mass is created, is aligned along each end to intersect each one of the two parallel sides at an angle 120 other than 90°. This creates a loop having a frusto-conical shape that accommodates a tapered mouthpiece.

Figure 3:
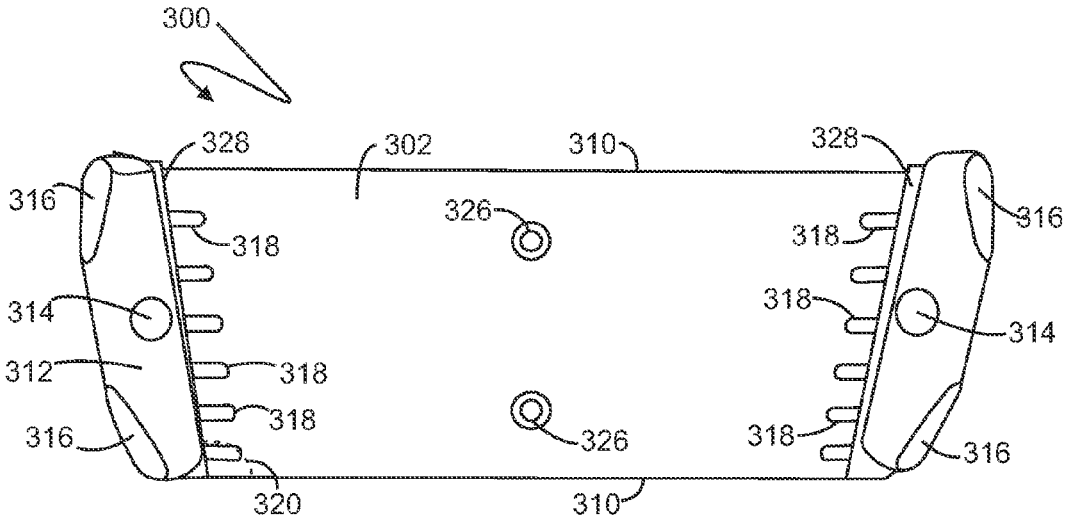
FIG. 3 is a plan view of a first side of another embodiment of a ligature in accordance with the present invention.
Figure 4:
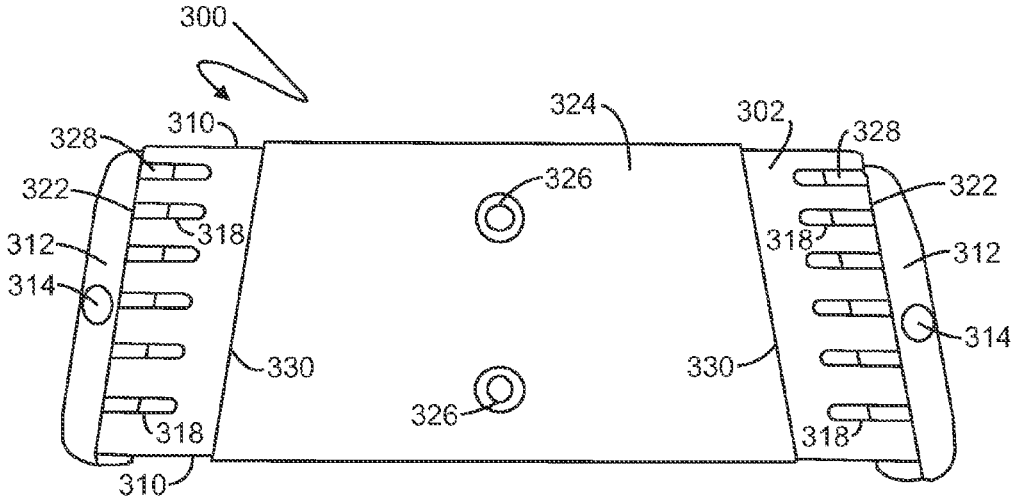
FIG. 4 is a plan view of a second side of the ligature of FIG. 3.

Referring to FIGS. 3 and 4, an exemplary embodiment of the ligature 300 of the present invention is illustrated, where the flexible or bendable strap 302 is thin metal. Suitable metals include copper, brass and stainless steel. As illustrated, the thin flexible strap is generally rectangular in shape; however, the strap can be other shapes including square, circular or trapezoidal. The strap is sized in accordance with the size of the mouthpiece to which the ligature is applied. In one embodiment, the flexible strap is about 1" to about 1.25" wide and about 3.5" to about 4" long. In one embodiment, the flexible strap has a thickness of about less than about 0.0625" and preferably about 0.01". The flexible strap can be formed into a loop by bringing the two ends together. The loop is sized to encircle a mouthpiece. Attached to an inner surface of the flexible strap is a cushioning or vibration dampening material 324. Suitable materials include polymers, elastomers and rubberized fabrics. The cushioning material is fixedly secured to the flexible strap, for example using a plurality of rivets 326 and is positioned to be between the flexible strap and the mouthpiece. The cushioning material is as wide as the flexible strap, and the length is less than the length of the flexible strap with ends 330 that generally parallel the ends of masses 312 of the ligature.

At either end of the flexible strap is a plurality of generally parallel slots 318 that have been cut out of the flexible metallic strap. Each slot runs from one of the ends a given distance into the strap in a direction that is generally parallel to the two parallel sides 310 of the flexible strap. As illustrated, each end contains six slots. The slots contribute additional compliance or form fitting flexibility to the strap to enhance the function of the ligature. The number of slots provided on each end can be varied depending on the amount of compliance desired or required.

In one embodiment, the ligature includes at least one mass 312 attached along the strap. Alternatively, a plurality of masses is attached along the flexible strap. Preferably, the ligature includes two masses. In one embodiment, the masses are substantially equal. The mass or combination of masses provides sufficient weight to the ligature to lower the passband frequencies of internal resonances of the ligature sufficiently below passband frequencies of the vibrating reed that is secured to the mouthpiece by the ligature. In general, the weight of the mass is significantly more than the weight of the flexible strap. In one embodiment, the ligature contains one mass attached to at least one of the ends of the flexible strap. In another embodiment, the ligature includes two masses, each attached to one of the ends of the flexible strap.

Suitable materials for the mass include any material that can produce an adequate amount of weight to achieve the desired passband frequency reduction within the space constraints of a mouthpiece. Preferably, the mass is metal. Suitable metals include, but are not limited to, copper, brass and stainless steel. In one embodiment, each mass is constructed from cylindrical bar stock having a diameter of from about 0.25" to about 0.5" and preferably about 0.375". The length of each cylindrical mass is from about 1" to about 1.5" and preferably about 1.25". The mass can also be a rectangular or square rod or any other elongated shaped. In one embodiment, each mass includes at least one diametric hole 314 disposed along the length of the cylindrical mass. When one diametric hole is included in each mass, the hole is located generally at the midpoint along the length of the cylindrical mass. In one embodiment, each hole has a diameter of about 0.15". In one embodiment, both ends of each mass include tapers 316, cutouts, bevels or chamfers. These two tapers can be used to adjust, i.e., remove, mass. In addition, the tapers provide clearance for the chin of a user when the ligature is attached a mouthpiece. In one embodiment, all of the masses are identical in size, weight and configuration. Since a mass may have to be rotated 180° depending on the end of the flexible strap to which it is attached, having identical tapers on either end of each mass facilitates placement of any given mass on either end of a flexible strap.

Each mass can be fixedly or removably secured to a given end of the flexible strap. Having masses removably attached facilitates exchanging or replacing masses. Preferably, each mass is fixedly secured to a given end of the flexible strap. Suitable attachment mechanisms include, but are not limited to, fasteners such as rivets and adhesives. In one embodiment, a slot 322, having for example a "U" shaped or rectangular cross section, is provided along the length of each mass. Each slot can extend either partially or entirely along the length of each mass and extends into the mass, for example either diametrically or non-diametrically. In one embodiment, each slot has a depth that extends partially into the cylindrical rod along a non-diametric secant line.

The ends of the flexible strap are inserted into the slot, and the mass is crimped closed on the strap, securely anchoring the strap into the mass. In this embodiment, the material of the strap provides the desired cushioning and vibrational isolation or dampening between each mass and the mouthpiece to which the ligature is attached. In one embodiment, an overlap is provided at each end to form two layers of the flexible strap that are inserted into the slot. Overlapping increases the stability of the bond between the mass and the strap. In addition, a flexible insert 328 is provided between the overlapping layers at the ends of the flexible strap. Suitable materials for the flexible insert include polymers, elastomers and rubberized fabric. In one embodiment, the material of the flexible insert is the same as the material of the cushioning insert. In one embodiment, the flexible insert has a thickness of less than about 0.0625" and preferably about 0.035". Although each mass can be attached to the flexible strap so that the mass intersects the sides 310 of the flexible strap at an angle 320 of about 90°, preferably each mass, i.e., the cylindrical rod from which the mass is created, is aligned along each end to intersect each one of the two parallel sides at an angle 320 other than 90°. This creates a loop having a frusto-conical shape that accommodates for a tapered mouthpiece.

Figure 5:
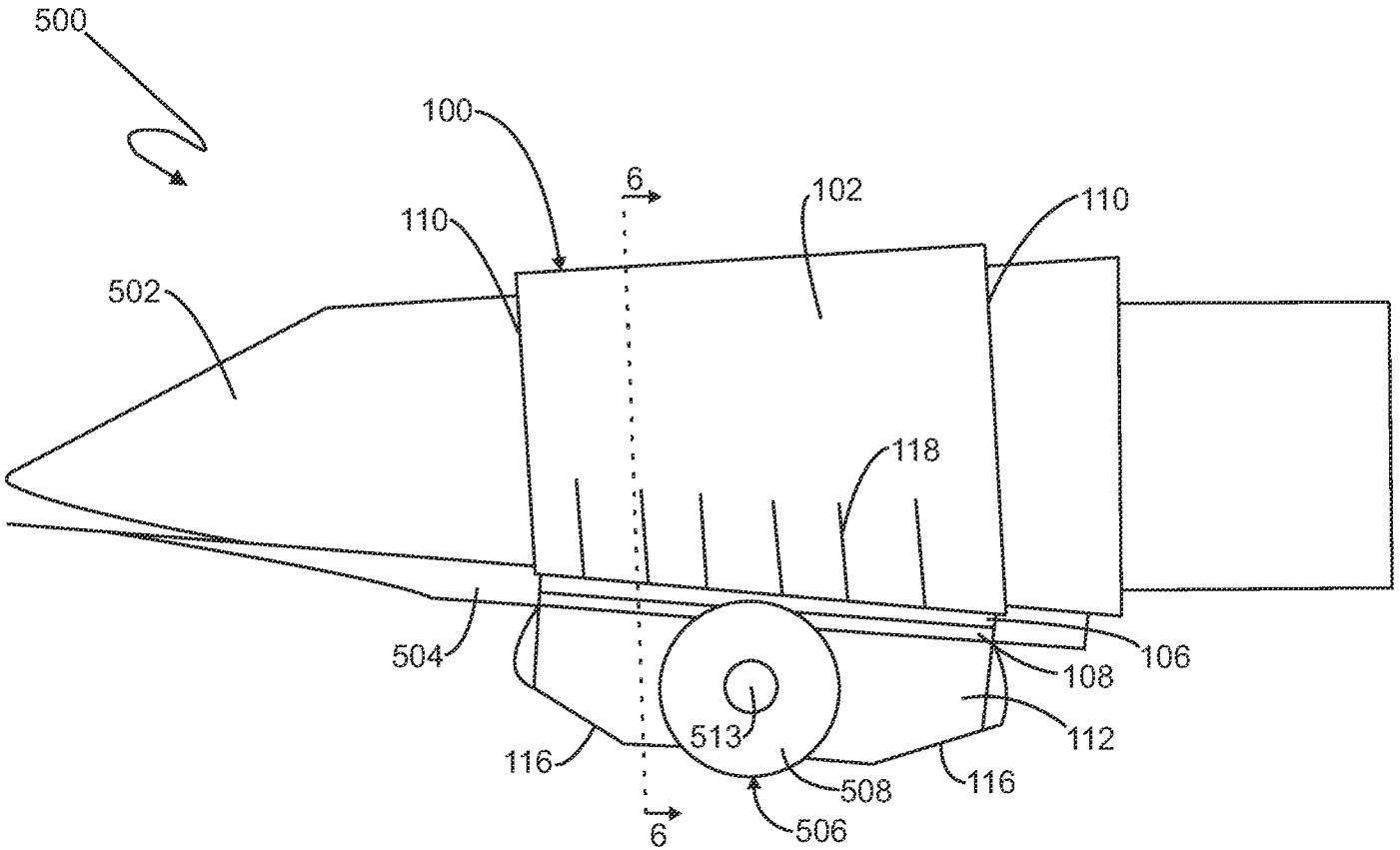
FIG. 5 is a side view of an embodiment of a mouthpiece system utilizing the ligature of FIG. 1.
Figure 6:
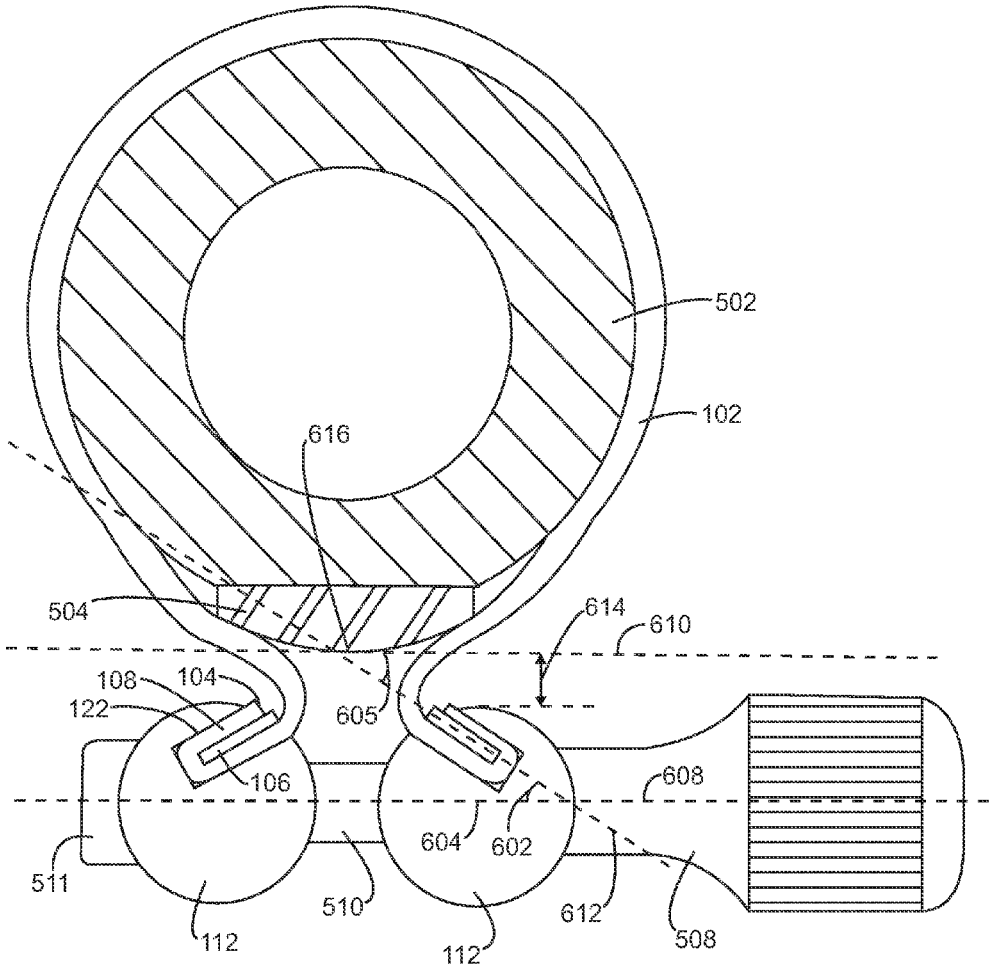
FIG. 6 is a view through line 6-6 of FIG. 5.

Referring to FIGS. 5 and 6, an exemplary embodiment of a woodwind mouthpiece system 500 utilizing the ligature in accordance with the present invention is illustrated. The system includes a mouthpiece 502, a reed 504 in contact with the mouthpiece and a ligature 100 surrounding the mouthpiece and the reed to secure the reed to the mouthpiece. In this embodiment, the ligature illustrated in FIGS. 1 and 2 is used. As illustrated, the ends of the flexible strap 102 are disposed over the reed 504 when the ligature 100 is attached to the mouthpiece 502. Therefore, each mass 112 is disposed generally adjacent the reed and spaced a given distance 614 from the reed by the flexible strap. Location of the mass adjacent the reed 504 dampens the vibration, i.e., the passband frequencies, of the flexible strap adjacent the reed. This prevents strap ligature vibrations from interfering with the vibration of the reed.

As is best illustrated in FIG. 6, the flexible strap forms a loop that encircles the mouthpiece 502 to secure the reed 504 to the mouthpiece. By drawing the masses and hence the ends of the flexible strap together, the strap tightens around the mouthpiece and the reed. As shown, each slot 122 within a given mass, extends into the mass partially along the non-diametric secant line 612. The non-diametric secant line does not pass through the center 604 of the circular cross section of the mass. In one embodiment, the secant line intersects a plane 610 tangent to the outer surface of the reed at a point 616 between the two ends or masses of the ligature at an angle 605 of from about 40° to about 45°. In one embodiment, the tangent point is disposed generally along the middle of the reed and preferably midway between the ends of the attached ligature. The non-diametric alignment in combination with the angle 605 translates the motion of bringing the ends and masses of the ligature together into both a constrictive force parallel to the plane 610 that tightens the flexible strap around the mouthpiece and a holding force perpendicular to the plane 610 that holds the reed against the mouthpiece.

The mouthpiece system includes a closure mechanism 506 that is in contact with and works in conjunction with the ligature to draw the ends and masses of the ligature together to tighten the ligature around the mouthpiece. In one embodiment, the closure mechanism is considered part of the ligature. Suitable closure mechanisms include clamps and threaded fasteners. Preferably, the closure mechanism is a threaded rod 510 that is passed through the holes 114 in each mass. The threaded rod has a head 511 that is larger than the diameter of the hole and threads along the distal end 513 to which a threaded thumbscrew or thumbnut 508 is attached. By turning the thumb screw in the proper direction, the masses are drawn together, applying a force that is decomposed into the constrictive force and perpendicular force and that tightens the ligature. In one embodiment, the alignment of the holes with respect to the slots 122 in conjunction with the closure mechanism function to define and to hold the angle 605 of the secant line with respect to the plane 610. Each hole 114 passes through the center 604 of the mass, and an angle 602 is defined between the center line 608 of the hole and the secant line 612 associated with the slot. This angle is the same as the angle 605 between the plane 610 and the secant line. Therefore, by establishing the hole and slot, the desired relationship between the masses, the flexible strap and the reed is established. In addition, the non-diametric alignment minimizes the amount of the ligature strap, either metal or flexible, that has to be cut or removed for the diametric hole that passes through each mass. Since the width of the ligature is selected to span as much of the length of the reed, preferably, the ligature is controlled along the entire width, i.e., the entire width contained within the slot. Therefore, any breaks in the contact between the ligature and the mass, for example the cut-outs required by the diametric mass holes, are minimized. Preferably, the breaks are limited to less than about 18% of the entire width of the ligature strap. In addition, the alignment and angle of the slot and hole form a bend in the ligature strap that spaces the masses from the reed and that function as an additional cushioning element between the masses and the reed.

Figure 7:
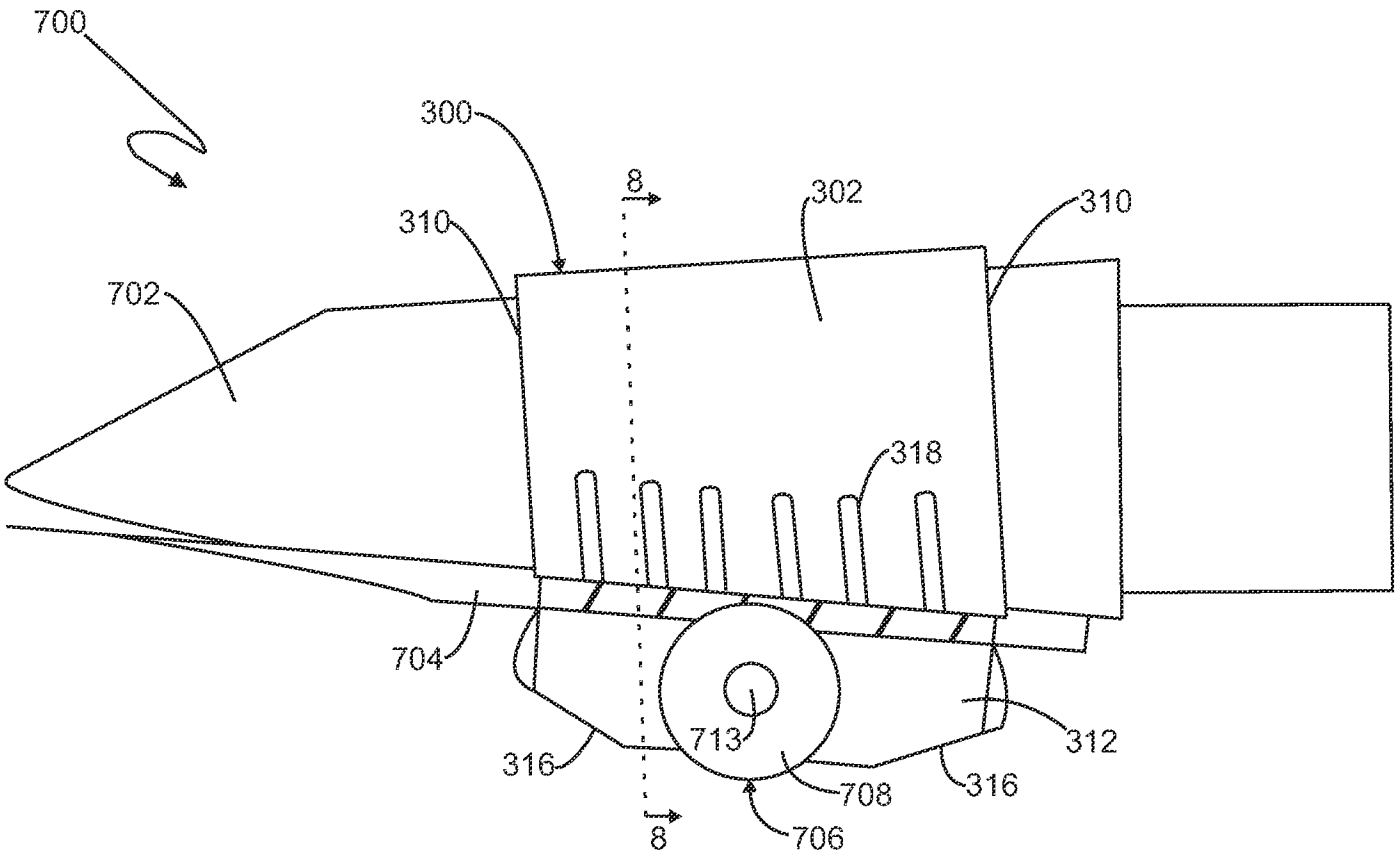
FIG. 7 is a side view of another embodiment of a mouthpiece system utilizing the ligature of FIG. 3.
Figure 8:
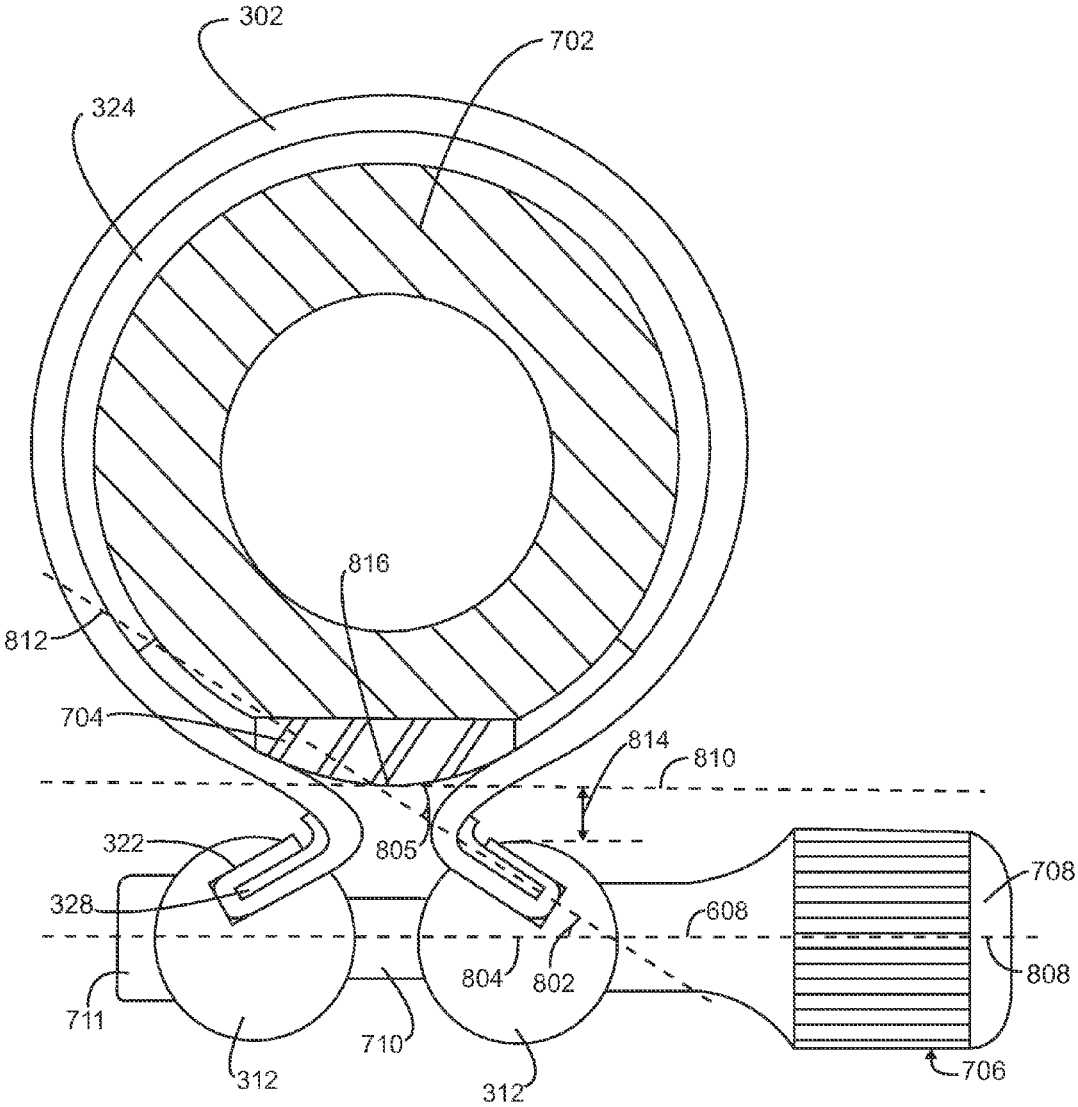
FIG. 8 is a view through line 8-8 of FIG. 7.
Figure 9:
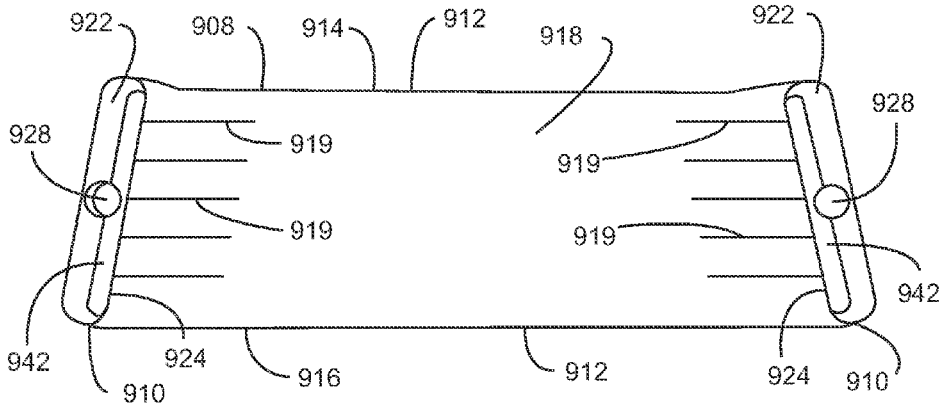
FIG. 9 is a plan view of a first side of another embodiment of a ligature in accordance with the present invention.
Figure 10:
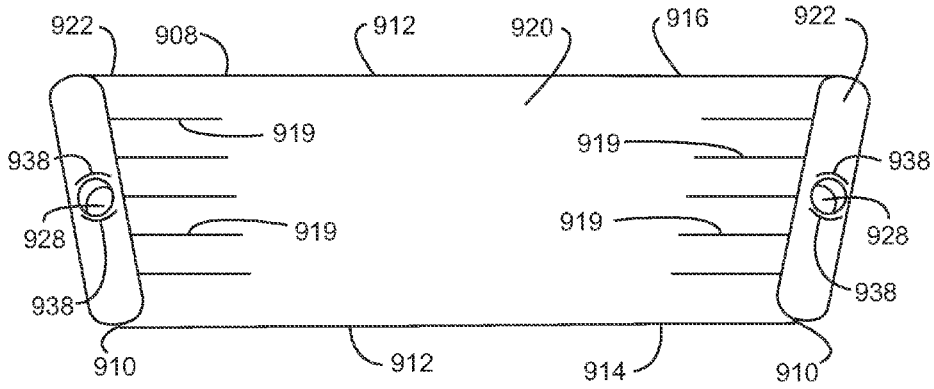
FIG. 10 is a plan view of a second side of the ligature of FIG. 9.
Figure 11:
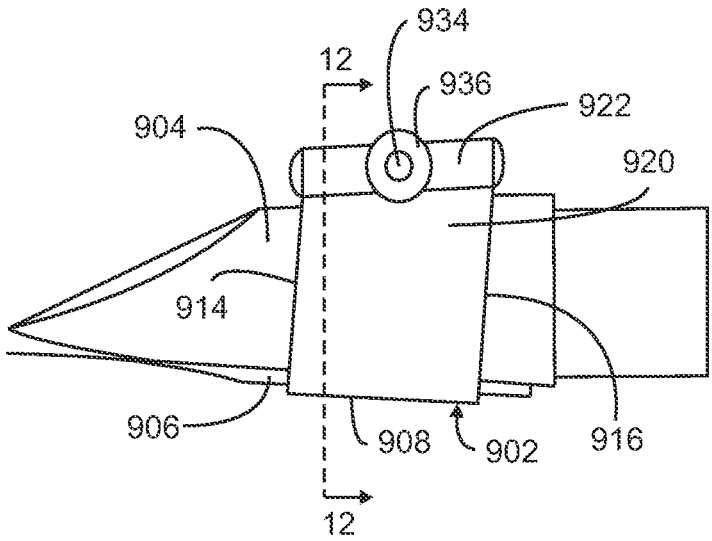
FIG. 11 is a side view of an embodiment of a mouthpiece system utilizing the ligature of FIG. 9.
Figure 12:
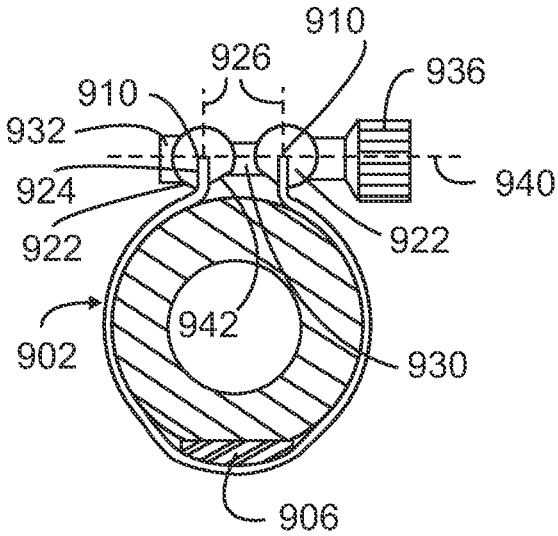
FIG. 12 is a view through line 12-12 of FIG. 11.

Referring to FIGS. 7 and 8, an exemplary embodiment of a woodwind mouthpiece system 700 utilizing the ligature in accordance with the present invention is illustrated. The system includes a mouthpiece 702, a reed 704 in contact with the mouthpiece and a ligature 300 surrounding the mouthpiece and the reed to secure the reed to the mouthpiece. In this embodiment, the ligature illustrated in FIGS. 3 and 4 is used. As illustrated, the ends of the flexible strap 302 are disposed over the reed 704 when the ligature 300 is attached to the mouthpiece 702. Therefore, each mass 312 is disposed generally adjacent the reed and spaced a given distance 814 from the reed by the flexible strap. Location of the mass adjacent the reed 704 in combination with the flexible insert 328 dampens the vibration, i.e., the passband frequencies, of the flexible strap adjacent the reed. This prevents strap ligature vibrations from interfering with the vibration of the reed.

As is best illustrated in FIG. 8, the flexible strap forms a loop that encircles the mouthpiece 702 to secure the reed 704 to the mouthpiece. By drawing the masses and hence the ends of the flexible strap together, the strap tightens around the mouthpiece and the reed. As shown, each slot 322 within a given mass, extends into the mass partially along the non-diametric secant line 812. The non-diametric secant line does not pass through the center 804 of the circular cross section of the mass. In one embodiment, the secant line intersects a plane 810 tangent to the outer surface of the reed at a point 816 between the two ends or masses of the ligature at an angle 805 of from about 40° to about 45°. In one embodiment, the tangent point is disposed generally along the middle of the reed and preferably midway between the ends of the attached ligature. The non-diametric alignment in combination with the angle 805 translates the motion of bringing the ends and masses of the ligature together into both a constrictive force parallel to the plane 810 that tightens the flexible strap around the mouthpiece and a holding force perpendicular to the plane 810 that holds the reed against the mouthpiece.

The mouthpiece system includes a closure mechanism 706 that is in contact with and works in conjunction with the ligature to draw the ends and masses of the ligature together to tighten the ligature around the mouthpiece. In one embodiment, the closure mechanism is considered part of the ligature. Suitable closure mechanisms include clamps and threaded fasteners. Preferably, the closure mechanism is a threaded rod 710 that is passed through the holes 314 in each mass. The threaded rod has a head 711 that is larger than the diameter of the hole and threads along the distal end 713 to which a threaded thumbscrew or thumbnut 708 is attached. By turning the thumbscrew in the proper direction, the masses are drawn together, applying a force that is decomposed into the constrictive force and perpendicular force and that tightens the ligature. In one embodiment, the alignment of the holes with respect to the slots 322 in conjunction with the closure mechanism function to define and to hold the angle 805 of the secant line with respect to the plane 810. Each hole 314 passes through the center 804 of the mass, and an angle 802 is defined between the center line 808 of the hole and the secant line 812 associated with the slot. This angle is the same as the angle 805 between the plane 810 and the secant line. Therefore, by establishing the hole and slot, the desired relationship between the masses, the flexible strap and the reed is established.

The ligature of the present invention for affixing the reed to the mouthpiece of a saxophone or clarinet utilizes both heavy weighting and compliance elements to subdue the effect of internal resonances in the ligature, thereby improving the performance of the mouthpiece system. The mass-loading is as fully implemented as is practicable, and the arrangement of the ligature is simpler and more cost effective. The mass loading lowers the passband frequencies of the internal resonances of the ligature well below the passband frequencies of the reed when the instrument is being played, eliminating any tendency of the ligature resonances to counter the vibration of the reed. The result is a tonality of greater depth and greater musicality in combination with a decrease in any tendency to deviate from accuracy of intonation.

When the elements of the ligature that provide the compliant interface with the reed are backed by weighted elements, the negative effects of the high compliance are completely mitigated, and the player experiences complete control of the instrument's performance. By fastening the body of the ligature into a fold-back that partially encloses a spring-like cushion, an extremely compliant interface with the reed is achieved. The ends of the body are terminated into large, weighted rods, into which fastening means are incorporated.

In accordance with another exemplary embodiment, the present invention is directed to a ligature for a mouthpiece and a mouthpiece system that yields a high level of playing performance at a relatively low cost. Ligatures in accordance with this embodiment can be made using a minimum amount of materials and a minimum amount of manufacturing labor. Referring to FIGS. 9-12, the ligature includes a loop 902 sized to encircle a mouthpiece 904 and reed 906 and to secure the reed 906 to the mouthpiece 904. The loop 902 is constructed from a single layer of a resilient, flexible strap 908 that has two opposing ends 910, and two opposing parallel sides or edges 912. The two opposing parallel sides include a first side 914 having a first length, i.e., from end to end, and a second side 916 having a second length. In one embodiment, the second length is greater than the first length. Therefore, the flexible strap, when formed into the loop has a frusto-conical shape that accommodates the taper on the mouthpiece.

Suitable materials for the flexible strap are described above. Preferably, the flexible strap is a rubberized fabric. In one embodiment, the flexible strap has a thickness of less than about ⅛ of an inch, for example about 1/16 of an inch and preferably about 1/32 of an inch. In one embodiment, the flexible strap has a thickness of about 0.01 inches. Therefore, the thickness of the flexible strap is consistent with the thickness of conventional metal ligatures that are provided with the single-reed woodwind mouthpieces. In addition, the single-reed woodwind mouthpieces are provided with a cap that completely covers the mouthpiece, reed and ligature to protect the reed from damage during storage and transport. Since the flexible strap of the present embodiment is provided as a single layer in a comparable thickness to the conventional metal ligature, a conventional cap can be used with the ligature of the present invention, eliminating the cost associated with purchasing a special, larger cap. Therefore, the ligature of the present embodiment can be simply substituted for conventional ligatures and provides the enhanced tonal qualities associated with using the flexible strap ligature.

In one embodiment, the flexible strap includes a first side 918 having a rough texture and a second side 920 having a smooth texture. The first side is the inner surface of the loop, and the second side is the outer surface of the loop. Therefore, the rough texture of the flexible strap is in contact with the mouthpiece and the reed. The rough texture of the flexible strap on the interior of the loop helps the ligature grip and hold the mouthpiece and reed. In addition, the rough texture improves the tonal qualities of the mouthpiece.

In one embodiment, extending partially across the flexible strap from either end of the flexible strap is a plurality of generally parallel slits 919. Each slit runs from one of the ends a given distance into the flexible strap in a direction that is generally parallel to the two parallel sides 912 of the flexible strap. In one embodiment, each slit extends across the flexible strap a distance of from about ¾ of an inch to about 1 inch. As illustrated, the flexible strap includes five slits adjacent either end; however, a larger or smaller number of slits can be provided as desired. In one embodiment, the slits are spaced from one another by a distance of about ⅛ of an inch to about ¼ of an inch. In order to preserve the integrity of the flexible strap, preferably each slit does not extend all the way to a respective end of the flexible strap. For example, the slit can begin about 1/16 to ⅛ of an inch from the end of the flexible strap. The slits contribute additional compliance or form-fitting flexibility to the strap to enhance the function of the ligature. The number of slits provided on each end can be varied depending on the amount of compliance desired or required.

Figure 16:
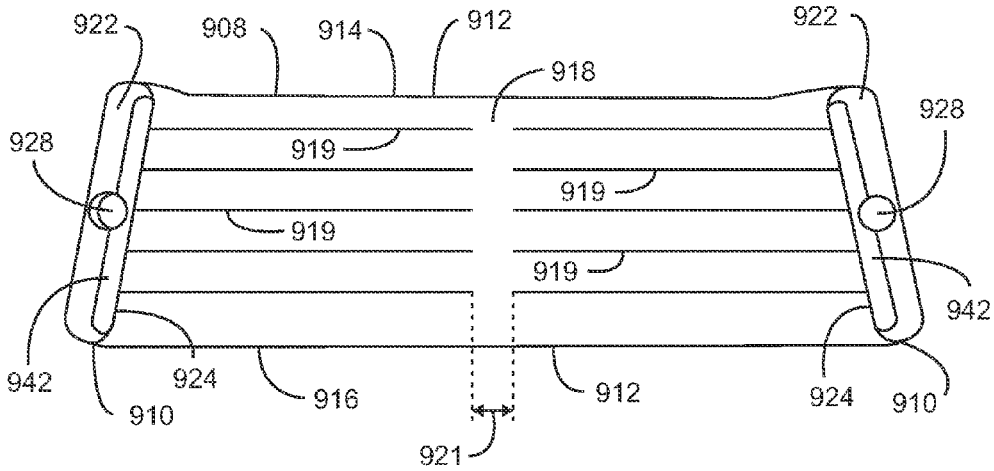
FIG. 16 is a plan view of a first side of another embodiment of a ligature having extended slits in accordance with the present invention.
Figure 17:
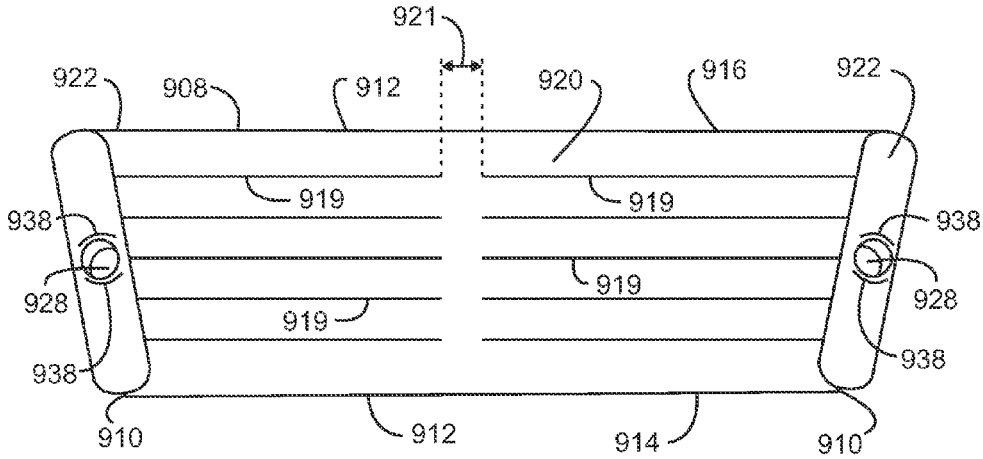
FIG. 17 is a plan view of a second side of the ligature of FIG. 16.

In one embodiment as illustrated in FIGS. 16-17, the parallel slits 919 are extended farther along the flexible strap from either end. In order to achieve improved compliance between the flexible strap of the ligature and the mouthpiece and reed, the parallel slits 919 in this embodiment are extended as far along the length of the flexible strap as possible without excessively compromising the integrity and function of the strap. For example, the parallel slits extend from each end such that the space 921 between the parallel slits represents only about 6% to about 7% of the entire length of the parallel slits, i.e., the length of the flexible strap, from end to end 910 of the flexible strap between the rigid bars 922. In one embodiment, this space represents a distance of about ¼ inch (5-10 mm).

Figure 18:
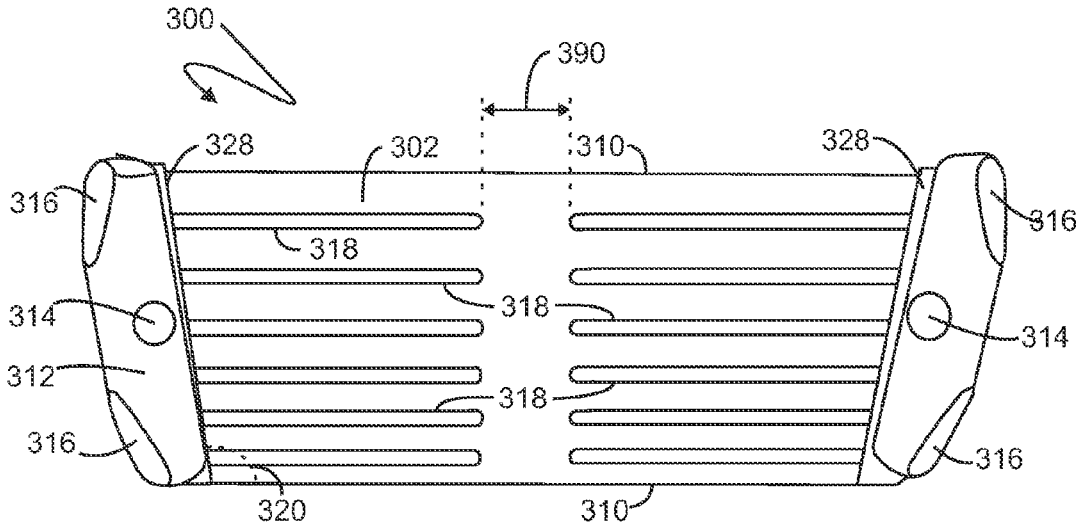
FIG. 18 is a plan view of a first side of another embodiment of a ligature having extended slots in accordance with the present invention.
Figure 19:
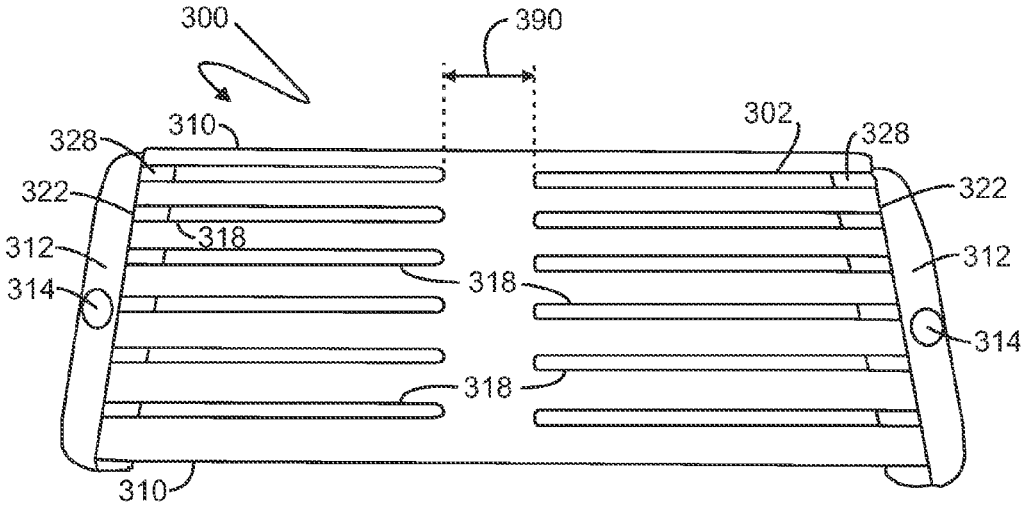
FIG. 19 is a plan view of a second side of the ligature of FIG. 18.
Figure 20:
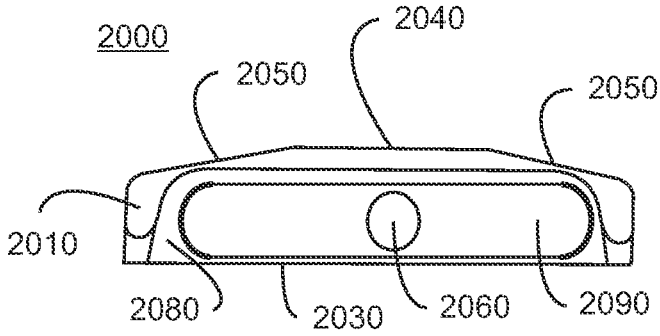
FIG. 20 is a plan view of a first side of an embodiment of a removable weight for use with the ligatures of the present invention.
Figure 21:
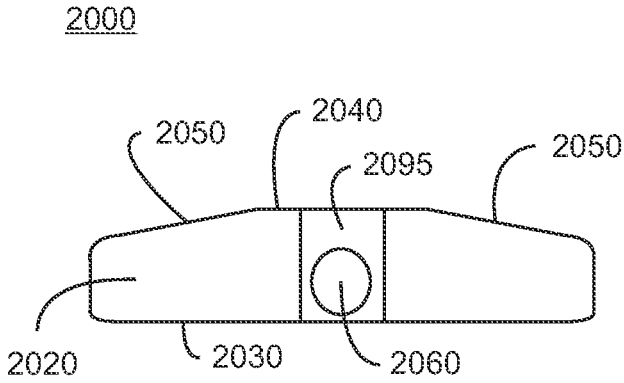
FIG. 21 is a plan view of a second side of the removable weight of FIG. 20.
Figure 22:
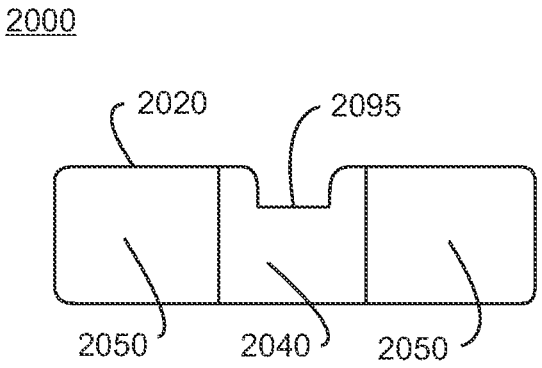
FIG. 22 is a plan view of a top side of the removable weight of FIG. 20.
Figure 23:
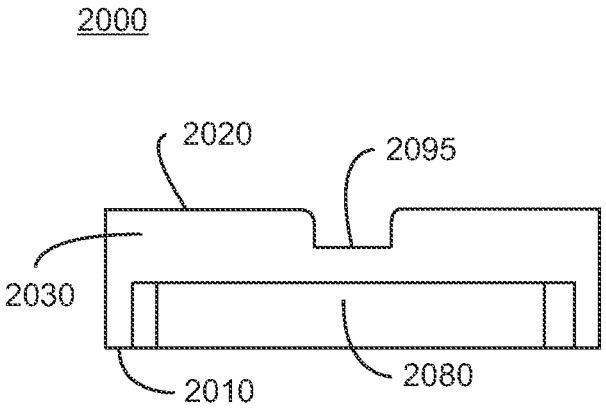
FIG. 23 plan view of a bottom side of the removable weight of FIG. 20.

Referring to FIGS. 18-19, the concept of extended slits is also applied to thin metal flexible straps 302, as provided, for example, in the embodiment of FIGS. 3-4. In this embodiment, the slits are parallel slots 318 that are extended farther along the length of the thin metal flexible straps. For example, the parallel slots extend from each end such that the space 390 between the parallel slits represents only about 16% to about 17.5% of the entire length of the parallel slots from end to end of the thin metal flexible strap between the masses 312. In one embodiment, this space represents a distance of about ½ to about 9/16 of an inch (10-15 mm). Although the extended parallel slits 919 and extended parallel slots 318 are illustrated with specific embodiments of rigid bars and masses, flexible straps with extended slits and slots can be used with any arrangement of bars and slits.

Returning to FIGS. 9-12, the ligature also includes a pair of rigid bars 922, preferably disposed on each end of the flexible strap. Suitable materials for the rigid bars include metals, plastics, elastomers, ceramics and combinations thereof. Suitable metals include brass, for example nickel or gold plated brass, and stainless steel. Each bar 922 is attached to one of the opposing ends of the flexible strap and extends between the opposing parallel sides 912. In one embodiment, each rigid bar is aligned along each end to intersect each one of the two opposing parallel sides at an angle other than 90° to create a frusto-conical shaped loop that accommodates for a tapered mouthpiece. In one embodiment, each rigid bar is a cylindrical rod having a diameter of about ¼ of an inch. In one embodiment, in order to attach each rigid bar 922 to an end 910 of the flexible strap, each cylindrical rod includes a slot 924 extending partially into the cylindrical rod and running along a length of the cylindrical rod. A corresponding end 910 of the single layer flexible strap is disposed and anchored in each slot. In one embodiment, each slot 924 extends diametrically into the cylindrical rod along a first diameter 926.

In one embodiment, each cylindrical rod 922 includes at least one hole 928 that passes completely through the cylindrical rod. The holes 928 accommodate the closure mechanism of the ligature that draws the rigid bars and, therefore, the ends of the flexible strap together to tighten the ligature around the mouthpiece 904 and the reed 906. In one embodiment, the closure mechanism is considered part of the ligature. Although various closure mechanisms, e.g., clamps and threaded fasteners, can be used, preferably, the closure mechanism is a threaded rod 930 that is passed through the holes 928 in each rigid bar. The threaded rod 930 includes a head 932 that is larger than the diameter of the hole and threads along the distal end 934 to which a threaded thumbscrew or thumbnut 936 is attached. By turning the thumbnut in the proper direction, the rigid bars are drawn together, applying a force that is decomposed into the constrictive force and perpendicular force and that tightens the ligature. In one embodiment, each cylindrical rod 922 includes notches 938 located adjacent each hole 928. These notches accommodate the heads 932 of the threaded rod 930 and prevent the threaded rod from spinning when the thumbnuts are tightened.

As was described above for other ligature embodiments, the alignment of the holes 928 with respect to the slots 924 in conjunction with the closure mechanism function to define and to hold the angle of the ends of the flexible strap with respect to the mouthpiece. In this embodiment, each hole passes diametrically through the cylindrical rod along a second diameter 940. In one embodiment, the first diameter is perpendicular to the second diameter. Preferably, the first diameter intersects the second diameter at an angle that deviates from perpendicular by up to about 7 degrees, alternatively up to about 3 degrees.

In one embodiment, each cylindrical rod includes a flat region 942 running the length of the cylindrical rod 922 and extending from one side of the slot 924 in that cylindrical rod partially around the circumference of the cylindrical rod. Therefore, the flat regions 942 are disposed in the interior of the loop formed by the flexible strap. The flat regions provide for the crimping of the ends of the flexible strap in the slot. In addition, the flat regions, being in the interior of the loop, provide clearance between the cylindrical rods and the mouthpiece as the ligature is placed around the mouthpiece and tightened.

Figure 13:
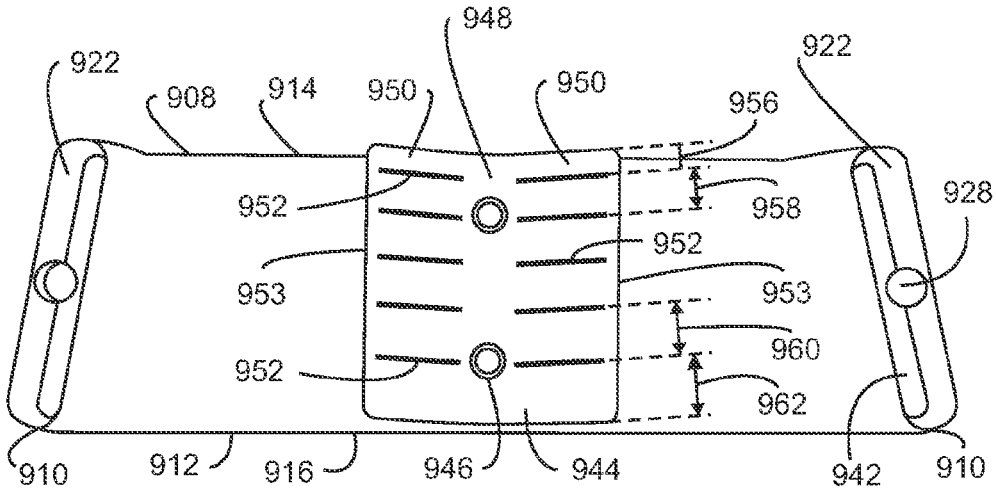
FIG. 13 is a plan view of a first side of another embodiment of a ligature in accordance with the present invention.
Figure 14:
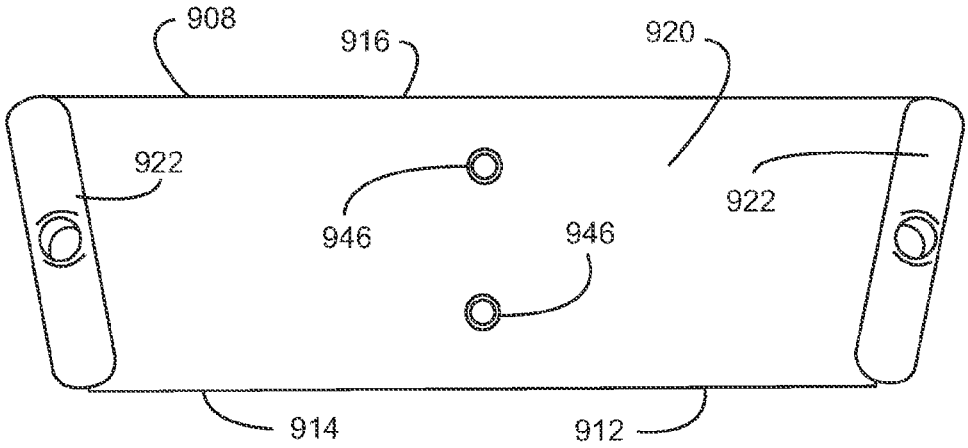
FIG. 14 is a plan view of a second side of the ligature of FIG. 13.
Figure 15:
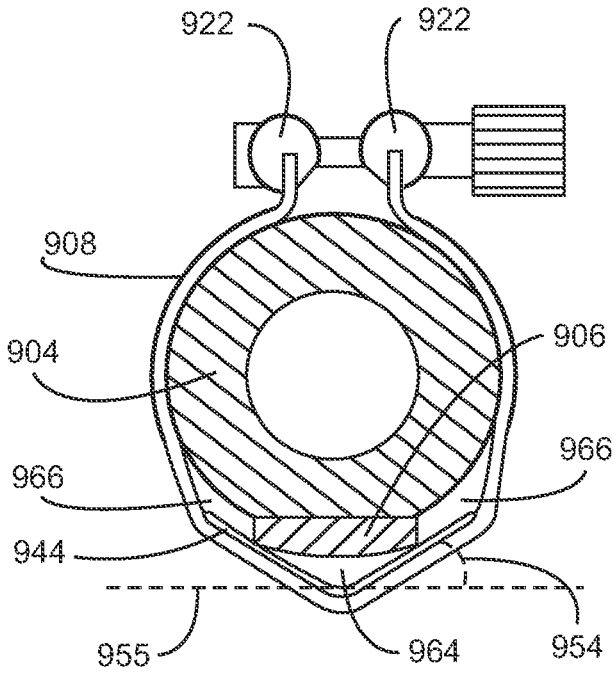
FIG. 15 is a cross-section view of an embodiment of a mouthpiece system utilizing the ligature of FIG. 13.

In accordance with another exemplary embodiment as illustrated in FIGS. 13-15, the present invention is directed to a ligature that includes a u-shaped cradle 944 attached to the flexible strap 908. Although illustrated as being attached to a particular ligature, the cradle 944 can be attached to any of the ligatures in any mouthpiece systems described herein. The cradle can be attached to the flexible strap using any type and any number of fasteners. Preferably, the cradle is attached to the flexible strap using two rivet connections 946. The cradle is constructed from a flexible or semi-flexible, resilient material. Preferably, the cradle is constructed from spring steel, i.e., stainless steel. The cradle is attached to the flexible strap between the two opposing ends 910 and is disposed on the interior 918 of the loop. Therefore, the cradle is interposed between the flexible strap body of the ligature and reed 906, contacting the reed only on the edges of the reed. This arrangement between the reed and the cradle significantly enhances the performance of the reed. The cradle is structured to behave as a spring-like element to permit free vibration of the reed but with sufficient stiffness to retain control by the player.

The cradle includes a central portion 948 in contact with the flexible strap 908 and a pair of wings 950 or sides extending from the central portion 948 to form the u-shape. As illustrated in FIG. 15, the wings extend from the central portion so as to form an angle 954 of from about 30 degrees to about 50 degrees with the flexible strap, for example, when the flexible strap is positioned flat in a single plane 955. Preferably, this angle 954 is about 40 degrees. Although the cradle 944 is u-shaped, is it constructed from a generally rectangular piece of resilient material, having, for example, dimensions of about 1 inch by about 1 inch.

Each wing includes a plurality of parallel slits 952. As illustrated, each wing includes 6 slits, although smaller or larger numbers of slits can be used. The slits are arranged on each wing such that the wings appear as mirror images. The parallel slits are arranged parallel to the opposing sides 912 of the flexible strap 908. Each slit is about ⅜ of an inch long. The slits do not extend to the edges 953 of the wings and do not extend into the central portion 948 of the cradle 944. This adds to the strength and resiliency of the cradle. The spacing between adjacent parallel slits varies. In particular, the distance between adjacent parallel slits increases when moving along each wing 950 from the first parallel side 914 to the second parallel side 916. In one embodiment, this variable distance increases from a first distance 958 of about 1/10 of an inch to a second distance 960 of about 2/10 of an inch. In addition, the cradle includes a leading edge spacing 956 from the first slit of about 1/10 of an inch and a trailing edge spacing 962 after the last slit of about 2/10 of an inch.

As is best illustrated in FIG. 15, the cradle 944 contacts the reed 906 along two lines, i.e., two points in cross section, that run along the edges of the reed. In addition, the cradle spaces the ligature, and in particular the flexible strap 908 away from the reed and mouthpiece, creating a top gap 964 between the reed and the ligature and two side gaps 966. These gaps improve the tonal qualities of the mouthpiece.

Referring to FIGS. 26-34, another embodiment of a ligature 3000 having a cradle 3010 is illustrated. This arrangement of ligature and cradle is suitable for use with mouthpieces for single-reed woodwind instruments. Although illustrated with a particular type of ligature, the cradle 3010 can be used in conjunction with any ligature and any mouthpiece system embodiment disclosed herein including ligature embodiments utilizing a flexible fabric material or a resilient flexible metallic material. In one embodiment, ligature includes a loop 3020 sized to encircle a mouthpiece. In one embodiment, the loop is formed from a flexible strap 3030 having two opposing ends 3040 and two opposing parallel sides 3050. Suitable flexible fabric materials are disclosed herein and include rubberized fabric materials. In one embodiment, the opposing ends 3040 of the flexible strap form the ligature ends 3041 that are drawn together to form the loop. In one embodiment, the flexible strap has a first side having a rough texture and a second side having a smooth texture. The first side can be arranged as an exterior surface of the loop, and the second side can be arranged as at least a portion of the interior surface of the loop. Preferably, the cradle is attached to the second side.

In another embodiment, the flexible strap 3030 is constructed as two overlapping layers, an exterior layer 3060 and an interior layer 3070. The interior layer 3070 includes both opposing ends 3040 of the flexible strap. Therefore, the opposing ends 3040 are disposed on the interior of the loop 3020. While extending along an interior surface of the exterior layer 3060, preferably, the opposing ends 3040 do not meet. Therefore, the interior layer 3070 does not completely cover or overlap the exterior layer 3060. The overlapping layers of the flexible strap can be selectively attached to fasten to each other so as to form pockets between the two layers. In one embodiment, the two overlapping layers are arranged to form two separate pockets 3080 disposed adjacent the ligature ends 3041.

The ligature includes a pair of rigid bars 3090 in contact with the flexible strap. Each bar extends between the opposing parallel sides of the flexible strap material. Suitable materials for the rigid bars include brass, black oxide brass, copper and stainless steel. Any suitable method for attaching the rigid bars to the flexible strap as discussed herein can be used. Preferably the rigid bars are disposed adjacent the ligature ends 3041. In one embodiment, a rigid bar 3090 is disposed in each one of the pockets 3080. The rigid bars provide rigidity to the ligature ends 3041. The rigid bars also function as a component of the closure mechanism that closes the flexible strap and holds the flexible strap in the loop. The closure mechanism also includes a threaded rod 3100 that is passed through the holes 3110 in the flexible strap material that are aligned with holes 3101 passing through each rigid bar. The threaded rod has a head 3120 that is larger than the diameter of the holes 3101 and threads along the distal end opposite the head to which a threaded thumbscrew or thumbnut 3130 is attached. By turning the thumb screw in the proper direction, the rigid bars are drawn together, closing the loop and applying a force that is decomposed into the constrictive force and perpendicular force and that tightens the ligature around a mouthpiece and reed.

In order to secure the flexible strap in the overlapping arrangement and to define and secure the pockets 3080 in the flexible strap, the two layers are bonded together at one or more locations along the length of the flexible strap. Suitable bonds include welds, adhesives and fasteners. In one embodiment, the bonds include stitching 3140 passing through the overlapping layers at two separate locations along the length of the flexible strap. In one embodiment, the stitching passes from the interior layer through to the exterior layers and extends between opposing parallel sides of the flexible strap. Preferably, the stitching does not extend completely between the parallel sides. The stitching secures the pockets in the flexible strap. Preferably, each bond or line of stitching is located between the ligature ends 3041 or pockets 3080 and the ends 3040 of the flexible strap. In one embodiment, the bonds and stitching are spaced back from the ends of the flexible strap 3040 a sufficient distances to form flexible flaps 3042 in the interior layer 3070 that can be flexed away from the interior surface 3061 of the exterior layer 3060 of the loop 3020. In one embodiment, each flexible strap has a length of from about 0.25" to about 0.5".

The cradle 3010 is attached to the flexible strap and is disposed within the interior of the loop 3020. Preferably, the cradle is attached to the interior surface 3061 of the exterior layer 3060 of the flexible strap. Suitable methods of attaching the cradle to the flexible strap include welds, adhesives and fasteners. In one embodiment, the cradle is attached to the flexible strap by a plurality of rivets 3011 that pass completely through the cradle 3010 and the flexible strap. Preferably, the cradle is attached to the flexible strap by two rivets 3011.

Figure 32:
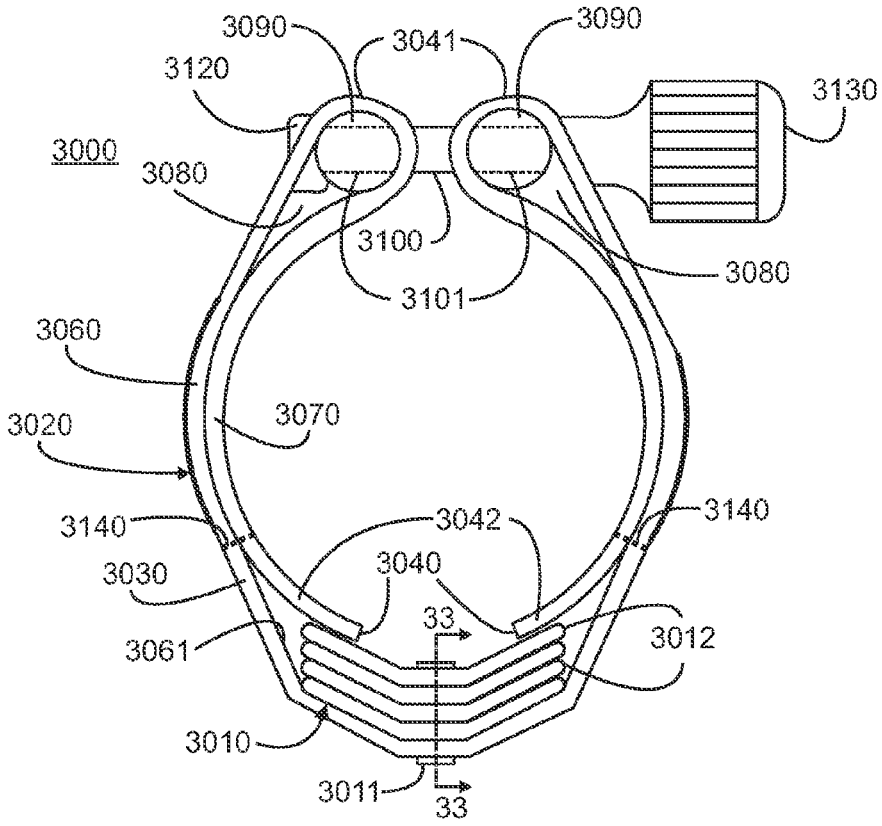
FIG. 32 is a view of an embodiment of a ligature with a layered cradle having flaps extending over the cradle in accordance with the present invention.
Figure 33:
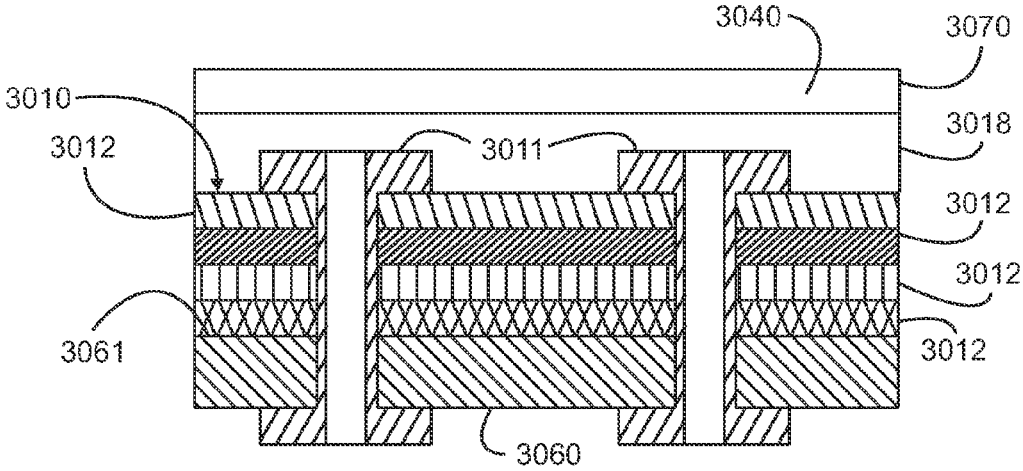
FIG. 33 is a view through line 33-33 of FIG. 32.
Figure 34:
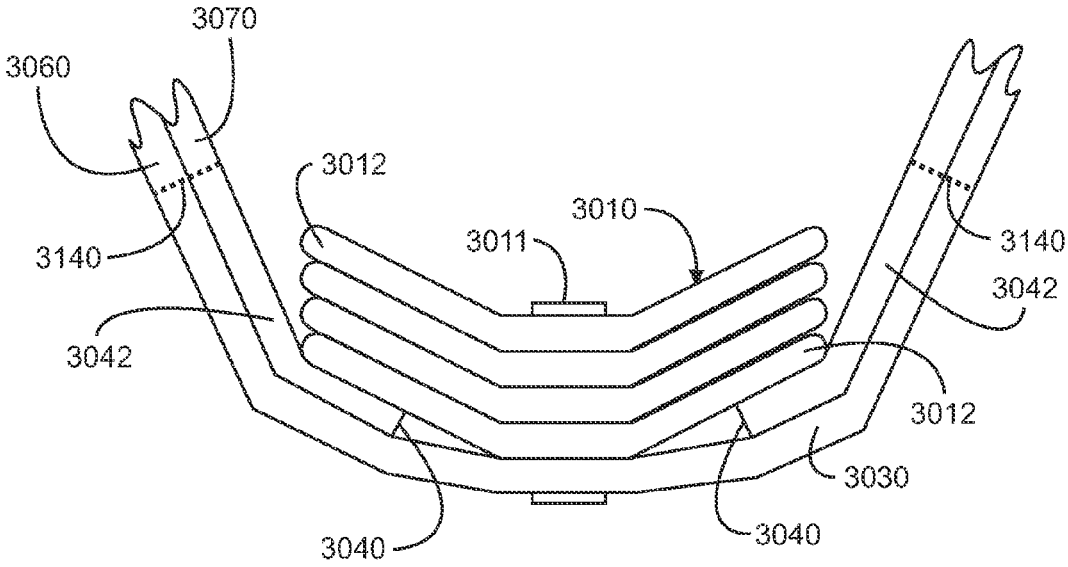
FIG. 34 is a partial view of an embodiment of a ligature with a layered cradle having flaps extending under the cradle in accordance with the present invention.

Preferably the cradle 3010 includes a plurality of separate and identical cradle members 3012 (FIGS. 32 and 33). In addition to using identical cradle members, the cradle members can each have a unique and complimentary shape that allows the cradle members to create the desired cradle size and shape when assembled together. Suitable materials for each cradle member include, but are not limited to, brass, black oxide brass, copper and stainless steel. Each cradle member can be flexible or deformable or rigid. The plurality of cradle members when combined to form the cradle forms a rigid structure, i.e., a structure that will not deform under the constrictive force of the ligature. The cradle members are fitted together to form the cradle. The cradle members are identical pieces and are configured to fit together to form the desired shaped of the cradle. Any suitable number of cradle members can be used. In one embodiment, the cradle includes four separate and identical cradle members. By adding additional cradle members to a given cradle, the rigidity and mass or weight of that cradle is increased. Therefore, the number of cradle members can be selected to produce a cradle having predetermined flexibility and weight characteristics. In one embodiment, the number of cradle elements is selected to produce a cradle having a weight sufficient to lower passband frequencies of internal resonances of the ligature sufficiently below passband frequencies of a vibrating reed secured to a mouthpiece by the ligature.

In one embodiment, the cradle members are overlapped and arranged in a stack. Therefore, the cradle and cradle members have a layered or laminated appearance. In one embodiment, the laminated layers can be bound together using adhesives or other bonds to form a solid, unitary cradle. Preferably, however, the laminated layers are not bound together except for the fastener that holds the cradle to the flexible strap. Therefore, the cradle members are loosely stacked and then simultaneously bonded to each other and to the flexible strap.

Each cradle member 3012 (FIGS. 28 and 29) is generally rectangular in shaped and formed from a stamped sheet of metal having a length 3014, a width 3013 less than the length and a thickness 3017. In one embodiment, each cradle has a size of length of about 1 and 3/16 of an inch and a width of about 11/16 of an inch. In one embodiment, each cradle member has a thickness of about 1/32 of an inch. Each cradle member can also include one or more holes 3016 passing completely through the cradle member to facilitate insertion of a fastener such as a rivet that is used to secure the cradle members to the flexible strap of the ligature.

Each cradle member includes a central portion 3019 extending along the length 3014 of the cradle member and a pair of wings 3018 running parallel to the central portion along the length of the cradle member and extending outward from the central portion along the width 3013 of each cradle member. The holes 3016 in each cradle member are preferably disposed in the central portion 3019. Therefore, each central portion is in contact with at least one fastener securing the cradle to the flexible strap. In one embodiment, the central portion and the wings are shaped to form a u-shape or v-shape. For example, the wings extend out of a plane that is defined by the central portion. In one embodiment, each wing extends from the central portion so as to form an angle 3006 of from about 10 degrees to about 20 degrees with the flexible strap, when the flexible strap is positioned flat in a single plane 3007. This is also the plane defined by the central portion. The shape each cradle member is also chosen to define the amount of each wing portion that is in contact with a reed that is secured to a mouthpiece using the ligature. This amount of contact can be viewed as a contact region 3005 on each wing 3018. In one embodiment, the contact region 3005 is a line, contacting the reed at only a point at any given location along the length 3014 of each cradle member. In another embodiment, each wing of each cradle member is shaped to contact the reed attached to the mouthpiece by the ligature along up to about 15% of a surface area of the reed that overlaps the cradle. Therefore, each contact region represents up to 15% of the surface area of the reed covered by the entire cradle members. As the cradle members are arranged in a stack, only the top cradle member in the stack is in contact with the reed. In addition, only one of the central portions is in contact with the flexible strap. This central portion is the central portion of the cradle member located at one end, e.g., the bottom, of the stack.

Figure 30:
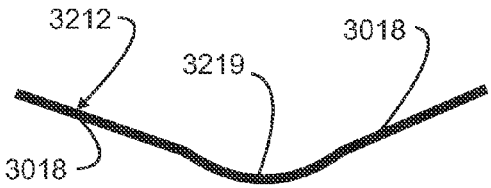
FIG. 30 is an end view of another embodiment of the cradle member.
Figure 31:
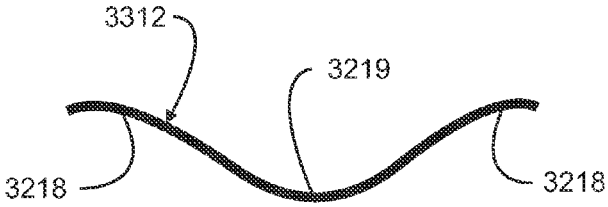
FIG. 31 is an end view of another embodiment of the cradle member.

In addition to being generally straight or planer, the central portion and wings of each cradle member can be varied to impart different mechanical properties to the cradle member or to influence the size and location of each contact region on each wing. As shown in FIG. 30, an embodiment of the cradle member 3212 is provided with a curved or trough shaped central portion 3219. This shape of the central portion decreases the amount of contact surface between the central portion and the flexible strap of the ligature. The wings 3018 are still generally flat or planar in configuration. In another embodiment as illustrated in FIG. 31, the cradle member 3312 has the curved central portion 3219 and curved wings 3218. The curved wings are curved backwards or in the opposite direction to the curve in the central portion. This configuration is used to enhance structural strength and rigidity and to minimize the contact region of each wing. Regardless of the shape and configuration of the central portion and the wings, the wings extend sufficient upwards away from the central portion so as to rise above the level of the fasteners 3011 (FIG. 33) and to hold the reed away from the central portion of the cradle members.

As discussed above and illustrated, for example, in FIG. 32, the flexible strap in one embodiment is formed as two overlapping layers defining an interior flexible strap layer 3070 and an exterior flexible strap layer 3060 of the loop 3020. The ends 3040 of the flexible strap are disposed in the interior flexible strap layer 3070 in the interior of the loop. Although the ends to not meet, touch or overlap, preferably each end 3040 extends into the region of the flexible strap that is covered by the cradle 3010. Therefore, the ends 3040 can extend or at least partially overlap the cradle, and at least a portion of each flap 3042 can overlap or extend over a portion of the cradle. As the strap is flexible and the flaps can be flexed away from the interior surface of the exterior layer of the flexible strap, the flaps can be selectively positioned either over or under the cradle. Given the position selected either the cradle will be in direct contact with the reed or the reed with contact the flap portions of the interior layer of the flexible strap. In one embodiment as illustrated in FIG. 32, the cradle 3010 is attached to the interior surface 3061 of the exterior layer 3060 of the flexible strap, and the cradle 3010 is positioned between each end 3040 and a portion of each flap 3042 and the interior surface 3061 of the exterior layer 3060 of the flexible strap. In one embodiment as illustration FIG. 34, the cradle 3010 is attached to an interior surface 3061 of the exterior layer 3060 of the flexible strap and each end 3040 and a portion of each flap 3042 is positioned between the cradle and the interior surface of the exterior layer of the flexible strap.

As with all ligatures disclosed herein, the multi-layered cradle embodiment of the ligature can be used in conjunction with a woodwind mouthpiece system, for example for a single-reed woodwind instrument. As illustrated herein, these mouthpiece systems include the mouthpiece, a reed in contact with the mouthpiece and the ligature surrounding the mouthpiece and the reed to secure the reed to the mouthpiece. The ligature and cradle can be positioned such that the cradle is located adjacent or in contact with the reed. Alternatively, the ligature is arranged so the cradle is located on an opposite side of the mouthpiece from the reed. In this arrangement, the rigid bars and ligature ends are located adjacent the reed.

The ligature and cradle arrangement of this embodiment can be used in a plurality of different configurations to achieve a plurality of different tones. For example, the ligature and cradle can be used in three different configurations to achieve three different tones. These different tones can all be achieved with the same ligature and cradle components, and no separate parts are required to affect the different tones. As illustrated, the flexible strap that encircles the mouthpiece is made of a flexible sheet material, preferably that of a rubberized fabric. The reed cradle 3010 is a thick, weighty element made of preferably, a stack of heavy metal stampings that is affixed with fasteners, such as rivets, to the inside of the ligature body. The cylindrical pins or rigid bars 3090 with cross-drilled holes are contained within pockets 3080 of the ligature body and enable the ligature to be secured to the mouthpiece. The inner flaps 3042 extend to overlay (FIG. 32) or underlay (FIG. 34) the cradle 3010 and are secured by a bonding or fastening mechanism 3140, preferably stitching, to the exterior layer 3060 of the ligature. In use the inner flaps 3042 may be juxtaposed either over or under the cradle to effect different tones. Likewise, the ligature may be inverted on the mouthpiece to affect another tone. The heavy weight of the cradle tunes the ligature resonances below the instrument's passband, thereby neutralizing the contribution of any enharmonic vibrations to the tones being produced. Because the construction is relatively simple and the materials relatively inexpensive, the ligature is enabled to provide excellent performance in a most cost effective manner.

Referring to FIGS. 20-23, an exemplary embodiment of a removable mass 2000 that is secured to a ligature or mouthpiece in accordance with the present invention is illustrated. A single mass is illustrated; however, a given ligature can have one, two or more masses removably or releasably attached. Preferably, the ligature includes two removable masses, one each attached to a given end of the ligature. Additional removable masses are added in pairs to the ends of the ligature. The masses can represent different amounts of mass or weight and can be added in groupings until the desired amount of mass has been added to the ligature. In one embodiment, the removable masses are provided in various matched pairs such that a given pair provides the desired amount of mass. Preferably, a given pair adds a sufficient amount of weight to the ligature to lower the passband frequencies of internal resonances of the ligature sufficiently below passband frequencies of the vibrating reed that is secured to the mouthpiece by the ligature.

The removable masses can be attached to the ends of the ligature through any suitable attachment mechanism. For example, the removable masses can be attached to the rods or masses that are securely fastened to the ends of the flexible strap by magnetic fasteners, two-part fasteners such as hook and loop type fasteners and threaded fasteners. Preferably the removable masses are attached to the ligature using the existing closure mechanism of the ligature. Suitable materials for the masses include brass, stainless steel and lead.

In one embodiment, a single pair of identical removable masses is provided for attachment to the ligatures of the present invention. One of the masses in a pair of identical removable masses is illustrated in the figures. The removable mass 2000 is arranged and shaped to work with the existing rods or weights on the end of the ligature in a form-fitting arrangement without adding excessive size to the ligature that would interfere with the playing of the mouthpiece.

As illustrated, the removable mass has a generally elongated rectangular shape and includes a first side 2010 having a cavity 2080 for accommodating the ends of the ligature. The size and shape of the cavity 2080 corresponds to the size and shape of the ends of the ligature to which it is attached. Typically, the ends of the ligature have a mass or rod attached to the flexible strap. Therefore, in one embodiment, the cavity 2080 includes an elongated curved pocket 2090 with curved ends that accommodates the cylindrical rods with rounded ends that are attached to the ends of the flexible strap of the ligature.

A second side 2020 is provided opposite the first side. This second side is generally flat, but has a channel 2095 running through the middle and spanning the entire width of the second side from a top side 2040 to a bottom side 2030. A hole 2060 passes from the channel 2095 to the cavity 2080. The hole 2060 accommodates the threaded rod of the closure mechanism, and the channel 2095 accommodates the head of the threaded rod. The top side 2040 includes tapers 2050 similar to the tapers on the fixed masses. As shown from the bottom side 2030, the cavity 2080 extends along the bottom side so that the rods at the end of the flexible strap are not completely covered or surrounded by the bottom side.

Figure 24:
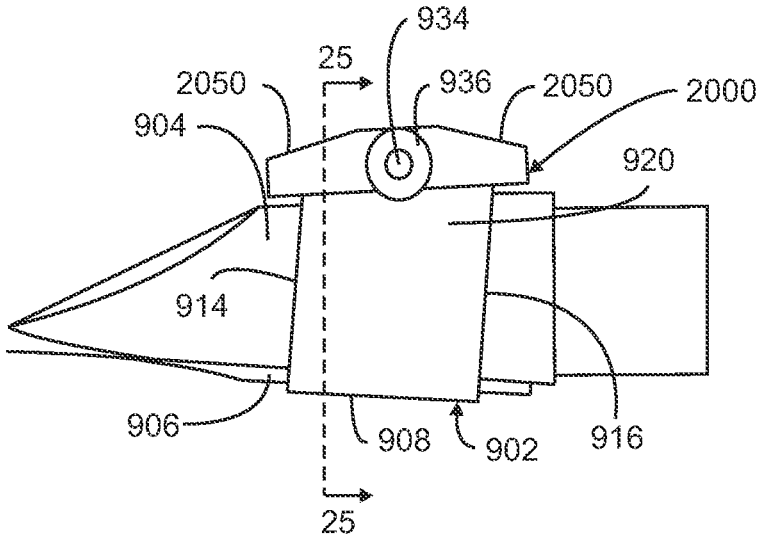
FIG. 24 is a side view of a mouthpiece system utilizing an embodiment of a ligature with removable masses in accordance with the present invention.
Figure 25:
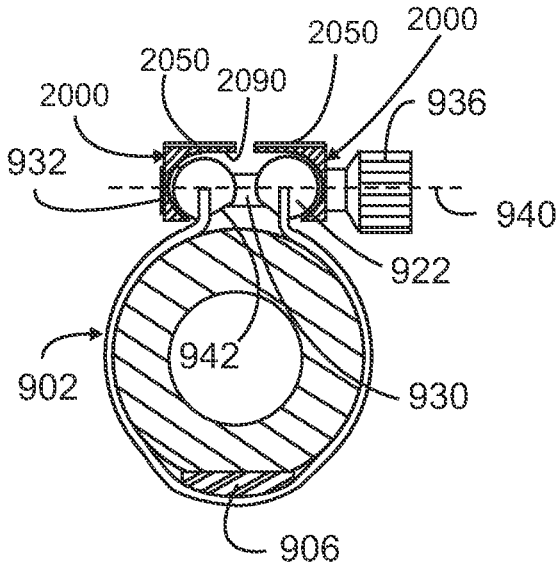
FIG. 25 is a view through line 25-25 of FIG. 24.
Figure 26:
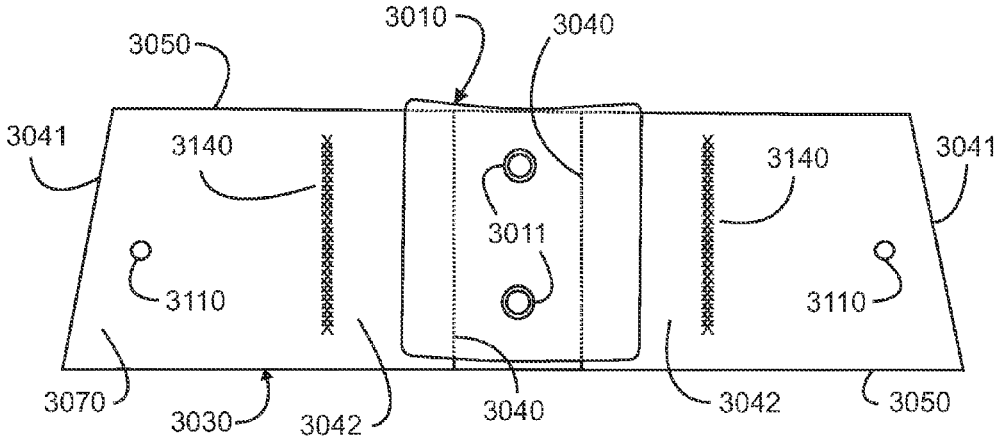
FIG. 26 is a view of the interior surface of an embodiment of a flexible strap and layered cradle for use in accordance with the ligatures of the present invention.
Figure 27:
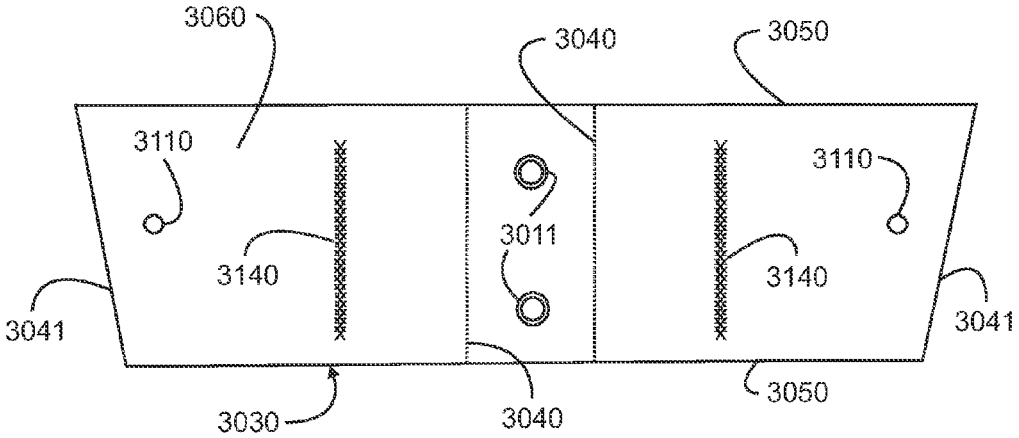
FIG. 27 is a view of the exterior surface of the embodiment of a flexible strap and layered cradle for use in accordance with the ligatures of the present invention.
Figure 28:
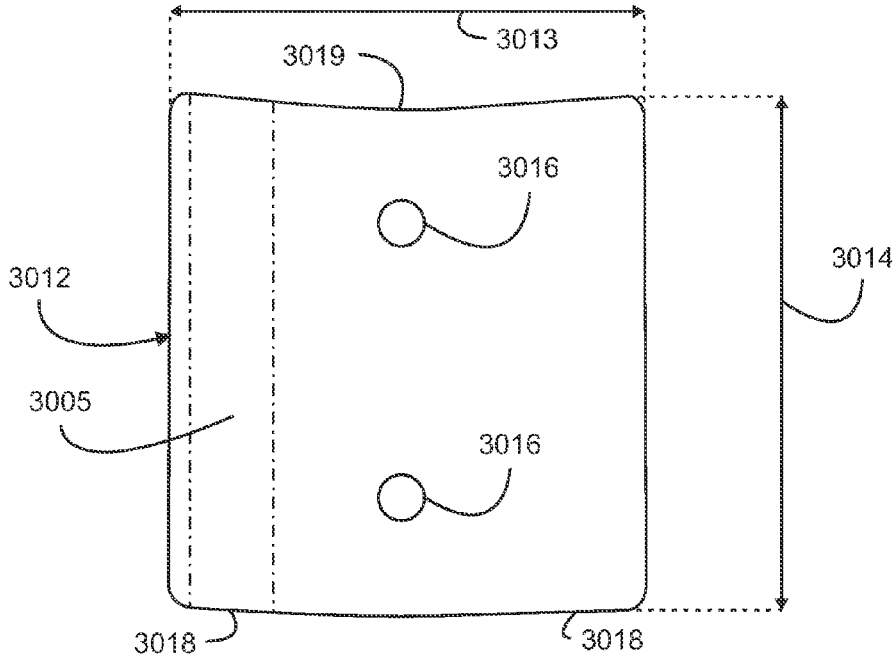
FIG. 28 is a view of one side of an embodiment of a cradle member for use in the layered cradle of the present invention.
Figure 29:
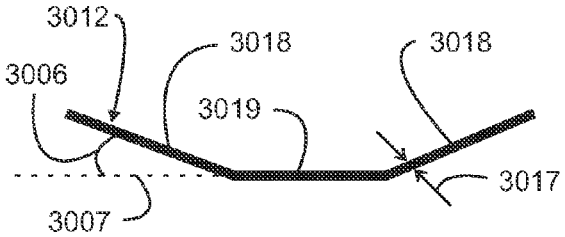
FIG. 29 is an end view of the cradle member embodiment of FIG. 28.

As illustrated in FIGS. 24 and 25, each removable mass is attached to an end of the flexible strap. Although illustrated with a particular embodiment of the ligature, the removable masses can be attached to any suitable type of ligature including all of the embodiments of ligatures disclosed herein. In addition, the removable masses can be positioned on the mouthpiece adjacent the reed 906 or on the opposite side of the mouthpiece from the reed 906. Each removable mass is placed around the cylindrical rods 922 at the end of the flexible strap such that the cylindrical rods rest in the curved pockets 2090 of the cavity. The threaded rod is passed through the hole in the second side of one of the removable masses until the head 932 is located within the channel 2095. The thumbscrew 936 is then threaded onto the rod, drawing the ends of the flexible strap of the ligature together and securing the removable masses to the ends of the ligature. In one embodiment, the removable masses are sized and arranged such that the bottom sides do not contact each other when the thumbscrew is tightened and the removable masses are secured to the flexible strap.

Figure 35:
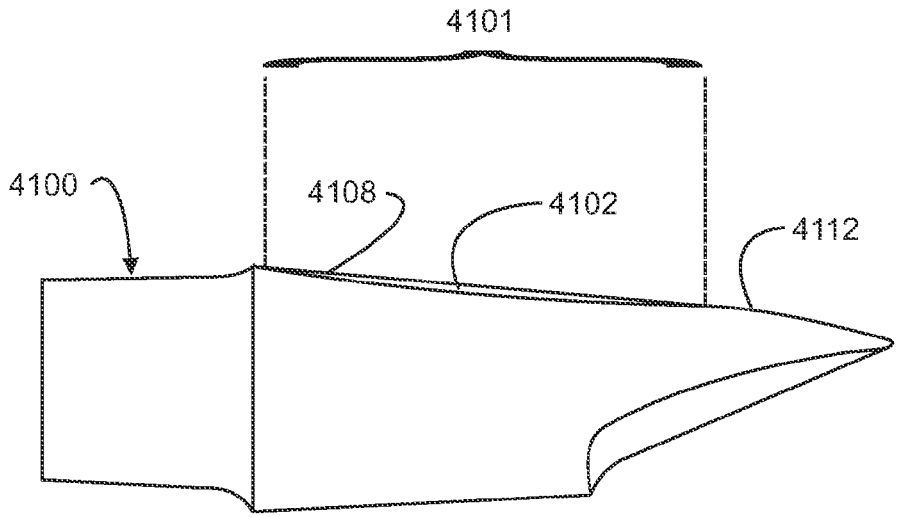
FIG. 35 is a side view of an embodiment of a mouthpiece with a bottom side cavity in accordance with the present invention.
Figure 36:
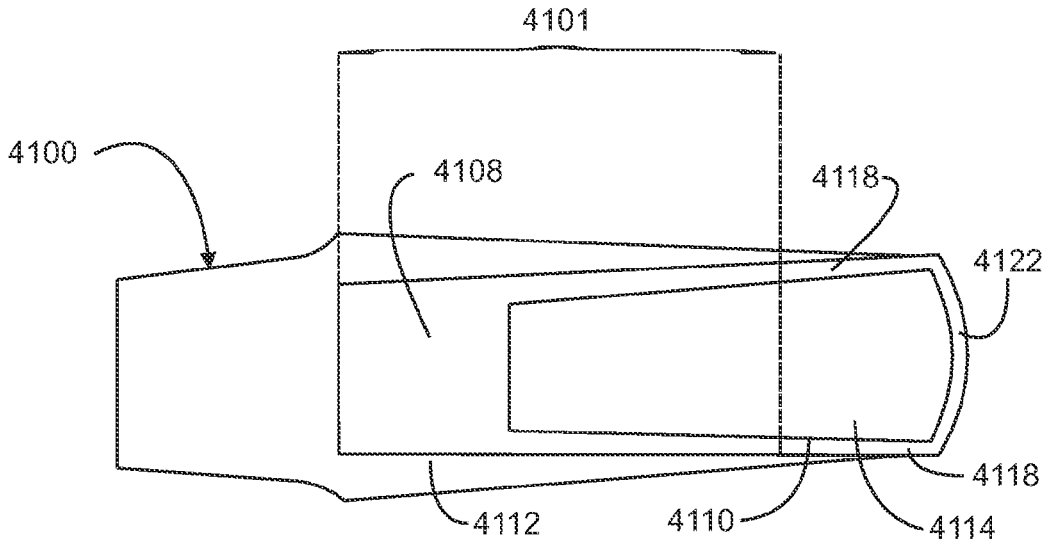
FIG. 36 is a bottom view of the mouthpiece with the bottom side cavity.

In accordance with one exemplary embodiment, the present invention is directed to a reed warp mouthpiece system for woodwind instruments. This system uses combinations of all of the embodiments of the mouthpieces, ligatures and reeds disclosed herein to create a mouthpiece system that compensates for the tendency of a reed to curl or warp to as it absorbs moisture during use. In general, these systems utilize combinations of mouthpieces having table top or side rail cavity, reeds having slits and ligatures covering a sufficient length of the reed. Referring to FIGS. 35-36, an exemplary embodiment of a mouthpiece 4100 having a cavity on its bottom side in accordance with the present invention is illustrated. The illustrated embodiment of the mouthpiece 4100, as well as the other illustrated embodiments of mouthpieces, is for use with a single reed woodwind instrument, for example a clarinet or saxophone. In general, the mouthpiece is arranged to support a reed that is secured to the mouthpiece with a ligature. In one embodiment, the mouthpiece has a typically elongated or barrel shape that tapers to either end. On a bottom side 4112 of the mouthpiece is an elongated window 4110 having a generally rectangular shape. The window may be tapered or narrower at one end or the other. In addition, one end of the window can include a bow or arch to match or compliment the curvature of the end of the reed. The side of the mouthpiece containing the window is considered the bottom side, because that side typically faces down or is on the bottom of the mouthpiece when the mouthpiece is attached to a musical instrument.

The window 4110 exposes a tone chamber 4114 within the mouthpiece and is in communication with a central bore passing through the mouthpiece. In general, the mouthpiece includes a tapered, reduced rear portion that is adapted to fit to the woodwind instrument in a conventional manner. The central bore has a length necessary to telescopically receive a neckpiece of the woodwind instrument. In one embodiment, the central bore is cylindrical. A table 4108 is disposed at one end of the window. The table is a flat surface on the bottom side of the mouthpiece and is situated to engage a bottom surface of a reed at the heel portion of the reed. This flat surface is the top of the table, and the top engages the bottom surface of the reed. The ligature securing the reed to the mouthpiece surrounds the mouthpiece around the table region of the mouthpiece.

The mouthpiece also includes a pair of side rails 4118 extending from the table and running along opposite sides of the window 4110. Each side rail 4118 frames one side of the window 4110. The side rails are parallel in that the side rails do not cross or intersect in the region of the window. Each side rail includes a side rail top surface running along the length of the side rail. The top surface of each side rail contacts the bottom surface of the reed. The mouthpiece also includes a tip rail 4122. The tip rail extends between the side rails at an end of the window opposite the table. In one embodiment, the tip rail extends along a generally straight line between the side rails. Preferably, the tip rail follows an outward arc between the side rails. The tip rail is in contact with the reed when the reed vibrates to close the window in the tone chamber. The shape of the tip rail can be the same as the shape of the tip of the reed or can be an arc having a different curvature than the tip of the reed. The bottom side of the mouthpiece includes a concave portion 4101. This is a curved or cutout portion that extends into the mouthpiece to define a gap 4102 between the reed and the mouthpiece. This gap can have a constant depth, or the depth can vary along the length of the gap, for example when a rounded concave portion is used. In one embodiment, the concave portion is located only in the table region of the mouthpiece, creating a gap between the table top and the heel portion of the mouthpiece. Alternatively, the concave portion extends at least partially along each side rail of the tone chamber window.

Figure 37:
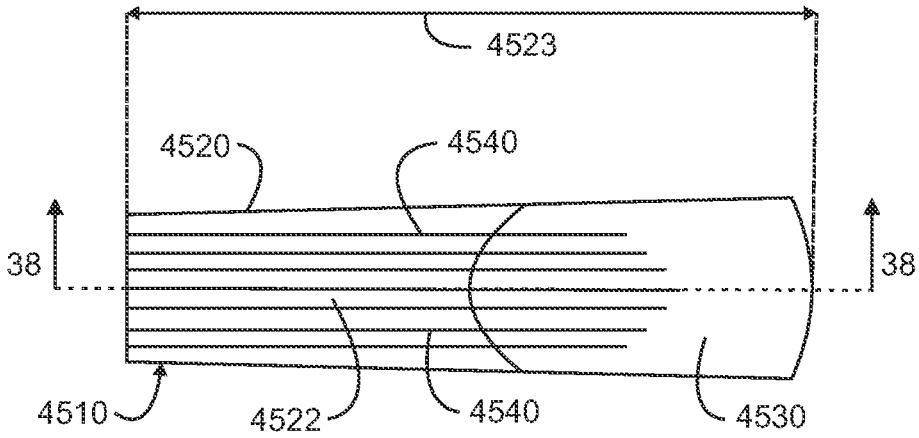
FIG. 37 is a top view of an embodiment of a reed with slits in accordance with the present invention.
Figure 38:
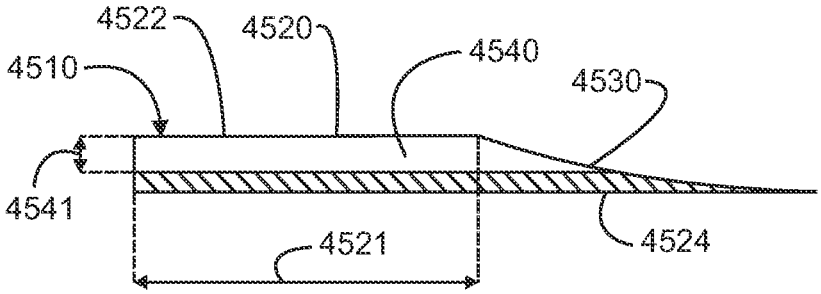
FIG. 38 is a view through line 38-38 of FIG. 7.

Referring to FIGS. 37 and 38, an embodiment of a reed 4510 for use in the reed warp mouthpiece system is illustrated. The reed is positioned on the bottom side of the mouthpiece and includes a heel section 4520 having a heel section length 4521 that extends over the table portion of the mouthpiece. The reed also includes a tapered portion 4530 extending from the heel portion. The tapered portion covers the rectangular tone chamber window of the mouthpiece. The heel section 4520 also includes a curved or rounded top surface 4522 that is arched across the width of the reed 4510 and a flat bottom surface 4524 opposite the rounded top surface. This bottom surface faces the bottom side of the mouthpiece and extends along the reed length 4523 from the heel portion to the tapered portion. The tapered portion tapers from a maximum thickness at its interface with the heel portion to a minimum thickness at the distal end of the reed. The top surface and a thin layer of material just below that top surface is the bark of the cane. Internal wood fibers of the cane constitute the remainder of the reed. The reed is preferably a unitary component fabricated from a section of commercially-available cane wood. However, other materials such as plastics may be utilized in the fabrication of the reed.

The reed includes a plurality of parallel slits 4540 running along the heel length. For example, the reed can include 5 or 7 slits. This plurality of slits 40 is cut into the top surface of the heel section in a direction parallel to and consistent with the grain of the cane wood (typically the reed's longitudinal axis). Each slit passes a given depth 4541 into the reed. This depth can be equal for each slit or because the top surface is rounded, each depth can vary in order to terminate at a common point or depth within the reed. In one embodiment, each slit extends through and along the length of the cane bark only and no internal wood fibers are removed or disturbed. This creates a discontinuous bark structure on the top surface of the heel portion. In one embodiment, each slit has a width of less than 0.0197 inches (0.5 mm), preferably less than or equal to 0.0098 inches (0.25 mm) and a depth of less than or equal to about 0.0625 includes (1.5 to 1.6 mm). In one embodiment, each slit runs only through the heel portion of the reed. Alternatively, the slit extends into tapered portion, terminating when the thickness of the tapered portion falls below the depth of the slit.

Since the reed absorbs moisture during use, the slits prevent reed warp as the wood fibers expand more rapidly than the bark. This prevention of warping allows the reed 10 to maintain the response, tone, and power of the attached instrument. In addition, the plurality of slits improves the intonation of the instrument to which the reed is attached. The location, arrangement and number of slits cut into the heel section is varied to optimize the tonal response/quality of the attached instrument, or to suit the personal taste or preference of a user.

The reed warp mouthpiece system can utilize that various embodiments of flexible fabric and thin metal ligatures disclosed herein. In one embodiment, the ligature surrounds the mouthpiece and reed to secure the reed to the mouthpiece and includes a flexible strap having opposing ends defining the flexible strap length. Opposing edges run between the opposing ends and define a width. The length passes around the mouthpiece and the reed, and the width is equal to the heel portion length so that the flexible strap completely covers the heel portion. In one embodiment, this width of the flexible strap is about 1.375 inches. The ligature also includes a pair of cylindrical masses. Each cylindrical mass is attached to one of the opposing ends of the flexible strap, for example using a slot in the mass or a loop arrangement in the end of the flexible strap. Each rod has a circular cross section and a cylindrical mass length equal to the width of the flexible strap. In one embodiment, the diameter of each rod is about 0.28 inches. The ligature can also include other features such as the additional removable weights and cradles.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A reed warp mouthpiece system comprising:
- a mouthpiece comprising a bottom side comprising;
  - a table portion; and
  - a rectangular window exposing a tone chamber and extending from the table portion;
- a reed disposed on the bottom side of the mouthpiece, the reed comprising:
  - a heel portion extending over the table portion and comprising a heel portion length; and
  - a tapered portion extending from the heel portion and covering the rectangular window; and
- a ligature surrounding the mouthpiece and reed to secure the reed to the mouthpiece, the ligature comprising:
  - a flexible strap having opposing ends defining a flexible strap length; and
  - opposing edges running between the opposing ends and defining a width, the length passing around the mouthpiece and the reed, the width equal to the heel portion length and the flexible strap arranged to completely cover the heel portion.

2. The system of claim 1, wherein the bottom side of the mouthpiece further comprises a concave portion extending into the mouthpiece, the concave portion defining a gap between the reed and the mouthpiece.

3. The system of claim 2, wherein the concave portion is disposed in the table portion of the bottom side.

4. The system of claim 3, wherein;
- the bottom portion further comprises a pair of side rails extending from the table portion along either side of the rectangular window; and
- the concave portion extends partially along each side rail.

5. The system of claim 1, wherein the width of the flexible strap comprises about 1.375 inches.

6. The system of claim 1, wherein the ligature further comprises a pair of cylindrical masses, each cylindrical mass attached to one of the opposing ends of the flexible strap and comprising a circular cross section and a cylindrical mass length equal to the width of the flexible strap.

7. The system of claim 6, wherein the circular cross section of each cylindrical mass has a diameter of about 0.28 inches.

8. The system of claim 1, wherein:
- the heel portion of the reed comprises a rounded top surface; and
- the reed further comprises:
  - a bottom surface opposite the rounded top surface, facing the bottom side of the mouthpiece and extending along a reed length from the heel portion to the tapered portion; and
  - a plurality of parallel slits running along the heel length in the heel portion and passing from the rounded top surface partially toward the bottom surface.

9. The system of claim 8, wherein the plurality of slits extend partially through the tapered portion.

10. The system of claim 8, wherein each slit comprises a width of less than about 0.25 mm and a depth less than or equal to 0.0625 inches.

11. A reed warp mouthpiece system comprising:

a mouthpiece comprising a bottom side comprising;

a table portion;

a rectangular window exposing a tone chamber and extending from the table portion; and a concave portion extending into the mouthpiece;

a reed disposed on the bottom side of the mouthpiece, the reed comprising:

a heel portion extending over the table portion and comprising a heel portion length and a rounded top surface;

a tapered portion extending from the heel portion and covering the rectangular window;

a bottom surface opposite the rounded top surface, facing the bottom side of the mouthpiece and extending along a reed length from the heel portion to the tapered portion, the concave portion of the bottom side of the mouthpiece defining a gap between the bottom surface of the reed and the bottom side of the mouthpiece; and a plurality of parallel slits running along the heel length in the heel portion and passing from the rounded top surface partially toward the bottom surface; and a ligature surrounding the mouthpiece and reed to secure the reed to the mouthpiece.

12. The system of claim 11, wherein the ligature comprises:

a flexible strap having opposing ends defining a flexible strap length; and opposing edges running between the opposing ends and defining a width, the length passing around the mouthpiece and the reed, the width equal to the heel portion length and the flexible strap arranged to completely cover the heel portion.

13. The system of claim 12, wherein the concave portion is disposed in the table portion of the bottom side.

14. The system of claim 13, wherein;

the bottom portion further comprises a pair of side rails extending from the table portion along either side of the rectangular window; and the concave portion extends partially along each side rail.

15. The system of claim 12, wherein the plurality of slits extend partially through the tapered portion.

16. The system of claim 12, wherein each slit comprises a width of less than about 0.25 mm and a depth less than or equal to 0.0625 inches.

17. A reed warp mouthpiece system comprising:

a mouthpiece comprising a bottom side comprising;

a table portion;

a rectangular window exposing a tone chamber and extending from the table portion; and a concave portion extending into the mouthpiece;

a reed disposed on the bottom side of the mouthpiece, the reed comprising:

a heel portion extending over the table portion;

a tapered portion extending from the heel portion and covering the rectangular window; and a bottom surface facing the bottom side of the mouthpiece and extending along a reed length from the heel portion to the tapered portion, the concave portion of the bottom side of the mouthpiece defining a gap between the bottom surface of the reed and the bottom side of the mouthpiece; and a ligature surrounding the mouthpiece and reed to secure the reed to the mouthpiece, the ligature comprising:

a flexible strap having opposing ends defining a flexible strap length; and opposing edges running between the opposing ends and defining a width, the length passing around the mouthpiece and the reed, the width equal to the heel portion length and the flexible strap arranged to completely cover the heel portion.

18. The system of claim 17, wherein the concave portion is disposed in the table portion of the bottom side.

19. The system of claim 17, wherein the ligature further comprises a pair of cylindrical masses, each cylindrical mass attached to one of the opposing ends of the flexible strap and comprising a circular cross section and a cylindrical mass length equal to the width of the flexible strap.

20. The system of claim 19, wherein the width of the flexible strap comprises about 1.375 inches and the circular cross section of each cylindrical mass has a diameter of about 0.28 inches.

* * * * *